US006554328B2

(12) United States Patent
Cetnar et al.

(10) Patent No.: US 6,554,328 B2
(45) Date of Patent: Apr. 29, 2003

(54) VEHICLE DOOR LOCKING SYSTEM WITH SEPARATE POWER OPERATED INNER DOOR AND OUTER DOOR LOCKING MECHANISMS

(75) Inventors: Roman Cetnar, Newmarket (CA); Thomas P. Frommer, Mount Albert (CA)

(73) Assignee: Atoma International Corporation, Newmarket (CA)

( * ) Notice: Subject to any disclaimer, the term of this patent is extended or adjusted under 35 U.S.C. 154(b) by 0 days.

(21) Appl. No.: 10/040,454

(22) Filed: Jan. 9, 2002

(65) Prior Publication Data

US 2002/0096890 A1 Jul. 25, 2002

Related U.S. Application Data

(63) Continuation of application No. 09/865,480, filed on May 29, 2001, now Pat. No. 6,341,807, which is a continuation of application No. 09/441,461, filed on Nov. 17, 1999, now Pat. No. 6,254,148, which is a continuation of application No. 09/018,467, filed on Feb. 4, 1998, now Pat. No. 6,102,453.

(60) Provisional application No. 60/036,850, filed on Feb. 4, 1997.

(51) Int. Cl.[7] ..... E05C 3/06

(52) U.S. Cl. ..... 292/201; 292/216; 292/DIG. 23

(58) Field of Search ..... 292/201, 216, 292/DIG. 23

(56) References Cited

U.S. PATENT DOCUMENTS

| | | | | |
|---|---|---|---|---|
| 4,093,289 | A | 6/1978 | Inabayashi et al. | 292/336.3 |
| 4,135,377 | A | 1/1979 | Kleefeldt et al. | 70/264 |
| 4,342,209 | A | 8/1982 | Kleefeldt | 70/264 |
| 4,575,138 | A | 3/1986 | Nakamura et al. | 292/216 |
| 4,616,862 | A | 10/1986 | Ward | 292/201 |
| 4,624,491 | A | 11/1986 | Vincent | 292/201 |
| 4,763,936 | A | 8/1988 | Rogakos et al. | 292/201 |
| 4,821,521 | A | 4/1989 | Schuler | 60/716 |
| 4,926,332 | A | 5/1990 | Komuro | 364/424.05 |
| 4,927,204 | A | 5/1990 | Asada | 292/216 |
| 5,137,312 | A | 8/1992 | Tang | 292/536.3 |
| 5,261,711 | A | 11/1993 | Mizuki et al. | 292/201 |
| 5,419,597 | A | 5/1995 | Brackmann et al. | 292/201 |
| 5,427,421 | A | 6/1995 | Hamaguchi | 292/216 |
| 5,453,671 | A | 9/1995 | Baier | 318/466 |
| 5,480,198 | A | 1/1996 | Wydler et al. | 292/144 |
| 5,516,167 | A | 5/1996 | Hayakawa | 292/337 |
| 5,649,726 | A | 7/1997 | Rogers, Jr. et al. | 292/201 |
| 5,667,259 | A | 9/1997 | Torkowski | 292/201 |
| 5,791,407 | A | 8/1998 | Hammons | 165/202 |
| 6,012,453 | A | 8/2000 | Cetnar | 292/201 |
| 6,254,148 | B1 * | 7/2001 | Cetnar et al. | 292/201 |
| 6,341,807 | B2 * | 1/2002 | Cetnar et al. | 292/201 |

FOREIGN PATENT DOCUMENTS

| | | | |
|---|---|---|---|
| DE | 19605452 | 2/1996 | |
| EP | 0589158 A | 3/1994 | |
| EP | 0637655 A | 2/1995 | |
| GB | 2254880 A | 10/1992 | |
| WO | WO 90/05822 | 5/1990 | 70/277 |

* cited by examiner

*Primary Examiner*—Anthony Knight
*Assistant Examiner*—John B. Walsh
(74) *Attorney, Agent, or Firm*—Pillsbury Winthrop LLP

(57) ABSTRACT

A power-operated vehicle door locking assembly including separate inner and outer door locking mechanisms connected with a housing assembly and an electric motorized system operable to selectively move (1) the inner door locking mechanism between an inoperative and an inner door locking position in response to inner manual electric motor energizing actuations and (2) the outer door locking mechanism between an inoperative and an outer door locking positions in response to outer manual electric motor energizing actuations. The arrangement is such that an outer manual electric motor energizing actuation without a corresponding inner manual electric motor energizing actuation causes a door latching assembly when in a door latching position to be incapable of being moved into a door unlatching position by an outer door latch releasing mechanism while at the same time the door latching assembly is capable of being moved into the door unlatching position thereof by an inner door latch releasing mechanism.

39 Claims, 26 Drawing Sheets

Vbatt
Vout
260
262
264
266
140
174
144
244
246
248
250
252
254
256
258
212
214
216
218
220
222
224
226
228
230
D1
C1
234
236
238
240
242
PROCESSOR
210
276
268
270
272
274

VEHICLE DOOR LOCKING SYSTEM WITH SEPARATE POWER OPERATED INNER DOOR AND OUTER DOOR LOCKING MECHANISMS

This is a Continuation of application Ser. No. 09/865,480, filed May 29, 2001 now U.S. Pat. No. 6,341,807, which is a continuation of Ser. No. 09/441,461, filed Nov. 17, 1999, now U.S. Pat. No. 6,254,148, which is a continuation of Ser. No. 09/018,467, filed Feb. 4, 1998, now U.S. Pat. No. 6,102,453, and further claims priority from provisional application No. 60/036,850, filed Feb. 4, 1997.

This invention relates to vehicle door locking assemblies and more particularly to vehicle door locking assemblies of the power-operated type.

A typical vehicle door locking assembly for a vehicle door movable between open and closed positions with respect to a vehicle body opening includes the following basic components. The assembly itself includes a housing assembly which is constructed and arranged to be mounted in the vehicle door. The vehicle door itself has inner and outer manually movable actuating members. The assembly includes a door latching assembly carried by the housing assembly so as to be moved (1) into a door latching position in response to the engagement of a striker in the vehicle body opening therewith occasioned by a movement of the vehicle door into the closed position thereof so as to latch the door in a closed position within the vehicle body opening and (2) from the door latching position thereof into a door unlatching position in order to allow the door to be moved into the opened position thereof. The assembly also includes outer and inner door latch releasing mechanisms which are mounted in the housing assembly to be moved (1) from inoperative positions into latch releasing positions in response to the manual movements of the outer and inner actuating members respectively from inoperative positions into door releasing positions and (2) from the latch releasing positions thereof into the inoperative position thereof.

The outer and inner latch releasing mechanism are operable such that when the vehicle door is closed movement of either from the inoperative position thereof to the latch releasing position thereof moves the door latching mechanism from the door latching position thereof to the door unlatching position thereof to allow the door to be moved to its open position.

The typical assembly includes a mechanical door locking mechanism which includes a key actuated assembly on the outer side of the door and a manual actuated assembly on the inside of the door. The mechanical locking mechanism simply effects a locking action simultaneously with regard to both the outer and inner door latch releasing mechanisms.

Beyond the typical mechanical door locking assembly, there have been many assemblies in which the locking mechanism is powerized by an electrical system energized by a source of electricity on the vehicle, such as the battery. These systems sometimes embodied solenoids and sometimes electrical motors with speed reduction gears. There is a need to provide locking assemblies in which the power operation is more versatile and more universally applicable to all of the various desirable functions which are required with respect to both front doors and rear doors in four door vehicles.

It is an object of the present invention to fulfill the need expressed above. In accordance with the principles of the present invention, this objective is obtained by providing a power-operated vehicle door locking assembly for a vehicle door movable between open and closed positions with respect to a vehicle body opening, the vehicle door having inner and outer manually movable actuating members. A housing assembly is constructed and arranged to be mounted in the vehicle door. A door latching assembly is carried by the housing assembly and is constructed and arranged to be moved (1) into a door latching position in response to the engagement of a striker in the vehicle body opening therewith occasioned by a movement of the vehicle door into the closed position thereof so as to latch the door in a closed position within the vehicle body opening and (2) from the door latching position thereof into a door unlatching position to allow the door to be moved into the open position thereof. The outer door latch releasing mechanism is constructed and arranged with respect to the door latching assembly so that when the vehicle door is in its closed position movement of the outer door latch releasing mechanism from the inoperative position thereof to the latch releasing position thereof moves the door latching assembly from the door latching position thereof to the door unlatching position thereof to allow the door to be moved into its open position. An outer door latch releasing mechanism is provided which is constructed and arranged with respect to the housing assembly to be moved (1) from an inoperative position into a latch releasing position in response to the manual movement of the outer actuating member from an inoperative position into a door releasing position and (2) from the latch releasing position thereof into the inoperative position thereof. An inner door latch releasing mechanism is provided with respect to the housing assembly constructed and arranged to be moved (1) from an inoperative position into a latch releasing position in response to the manual movement of the inner actuating member from an inoperative position into a door releasing position and (2) from the latch releasing position thereof into the inoperative position thereof. The inner door latch releasing mechanism is constructed and arranged with respect to the door latching assembly so that when the vehicle door is in its closed position movement of the inner door latch releasing mechanism from the inoperative position thereof to the latch releasing position thereof moves the door latching assembly from the door latching position thereof to the door unlatching position thereof to allow the door to be moved into its open position. Separate inner and outer door locking mechanisms are connected with the housing assembly. The outer door locking mechanism is constructed and arranged with respect to the housing assembly to be moved between inoperative and outer door locking positions. The outer door locking mechanism is constructed and arranged with respect to the outer door latch releasing mechanism to disable the outer door latch releasing mechanism from moving from the inoperative position thereof into the latch releasing position thereof when the outer door locking mechanism is in the door locking position thereof. The inner door locking mechanism is constructed and arranged with respect to the housing assembly to be moved between inoperative and inner door locking positions. The inner door locking mechanism is constructed and arranged with respect to the inner door latch releasing mechanism to disable the inner door latch releasing mechanism from moving from the inoperative position thereto into the latch releasing position thereof when the inner door locking mechanism is in the door locking position thereof. An electrically operable system is provided constructed and arranged to convert a source of electricity on the vehicle into mechanical motion in response to manual electrical energizing actuations. The electrically operable system is constructed and arranged with respect to the inner and outer door locking mechanisms to selectively move (1) the inner door locking mechanism between the inoperative and inner door locking position thereof in response to inner manual electrical energizing actuations and (2) the outer door locking mechanism between the inoperative and outer door locking positions thereof in response to outer manual electrical energizing actuations, the arrangement being such that an outer manual electrical energizing actuation without a corresponding inner manual electrical energizing actuation causes the door latching assembly when in the door latching position thereof to be incapable of being moved into the door unlatching position thereof by the outer door latch releasing mechanism while at the same time the door latching assembly is capable of being moved into the door unlatching position thereof by the inner door latch releasing mechanism.

Preferably, the assembly includes a key actuated door locking and unlocking assembly which is constructed and arranged with respect to the housing assembly to be moved between a locked mode and an unlocked mode in response to the manual movement of a key therein. The key actuated door locking and unlocking assembly is preferably constructed and arranged with respect to the electrically operable system to provide outer electrical energizing actuations for said electrically operable system when moved away from the locked and unlocked modes thereof by manual movements of a key therein. In addition, it is preferable that the key actuated assembly is capable of overriding the electrically operable system to effect movement of the outer door locking mechanism between its inoperative and latch releasing positions when the source of electricity on the vehicle is no longer available. The key actuated assembly are provided with access from the outside of the front doors. Preferably, the rear doors do not include outside access but instead access to the door only when the door is open as by being mounted to provide access at the edge of the door which is enclosed when the door is closed.

Finally, preferably there is circuitry including a processor which is capable of providing various actuating and deactuating capabilities for the electrically operated systems.

These and other objects of the present invention will become more apparent during the course of the following detailed description and appended claims.

DETAILED DESCRIPTION OF THE PREFERRED EMBODIMENT SHOWN IN THE DRAWINGS

Figure 3:
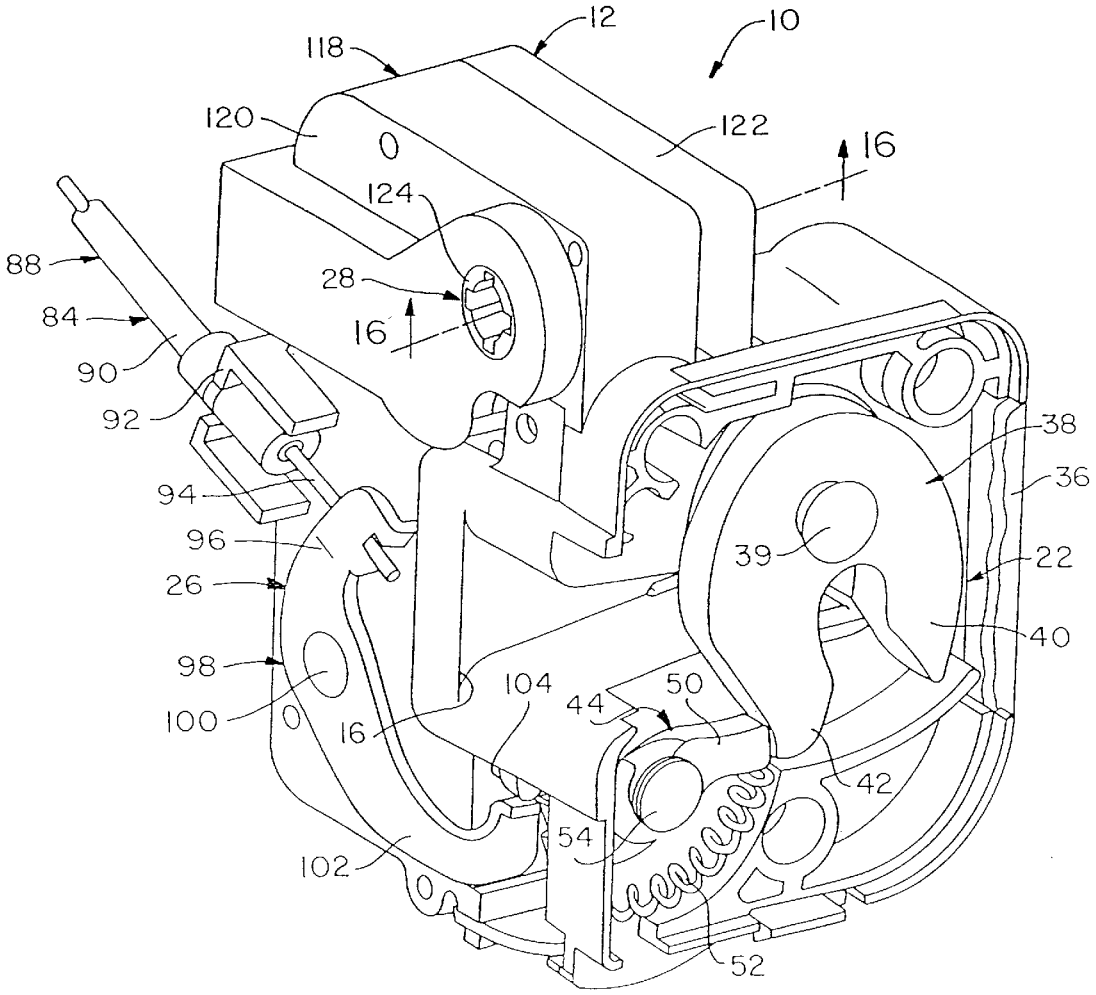
FIG. 3 is a perspective view of an automatic vehicle door locking assembly embodying the principles of the present invention, the view is looking at the inside and free end of the assembly as it would be mounted in a vehicle door, the end plate of the assembly is shown broken away to more clearly illustrate the components.

Referring now more particularly to the drawings, there is shown in FIG. 3 an automatic vehicle door locking assembly, generally indicated at 10, which embodies the principles of the present invention. The automatic vehicle door locking assembly 10 includes, in general, a housing assembly, generally indicated at 12, which includes separate mechanism carrying housings which are combined together so as to be mounted as a unit within each of four vehicle doors 14, the front and rear right hand doors 14 being shown in FIG. 1. See also FIG. 15 which illustrates a cross-section of the assembly 10 mounted in the closed rear door 14. The housing assembly 12 provides a recess structure 16 in the free end of the door which is adapted to receive a conventional striker 18 suitably mounted in a cooperating vehicle door frame 20 and shown in FIG. 16.

The mechanisms carried by the housing assembly 12 include a door latching assembly, generally indicated at 22, components of an outer door latch releasing mechanism, generally indicated at 24, components of an inner door latch releasing mechanism, generally indicated at 26, and a key-actuated door locking and unlocking assembly, generally indicated at 28, which includes a separate power operated outer door locking mechanism, generally indicated at 30, and a separate power operated inner door locking mechanism, generally indicated at 32.

As best shown in FIG. 3, the recess providing structure 16 forms a fixed part of a main housing sub-assembly 34. Fixed to the main housing sub-assembly 34, as by suitable bolts or the like, is an outer plate 36 which likewise has a recess therein confirming to the recess-defining structure 14.

Figure 4:
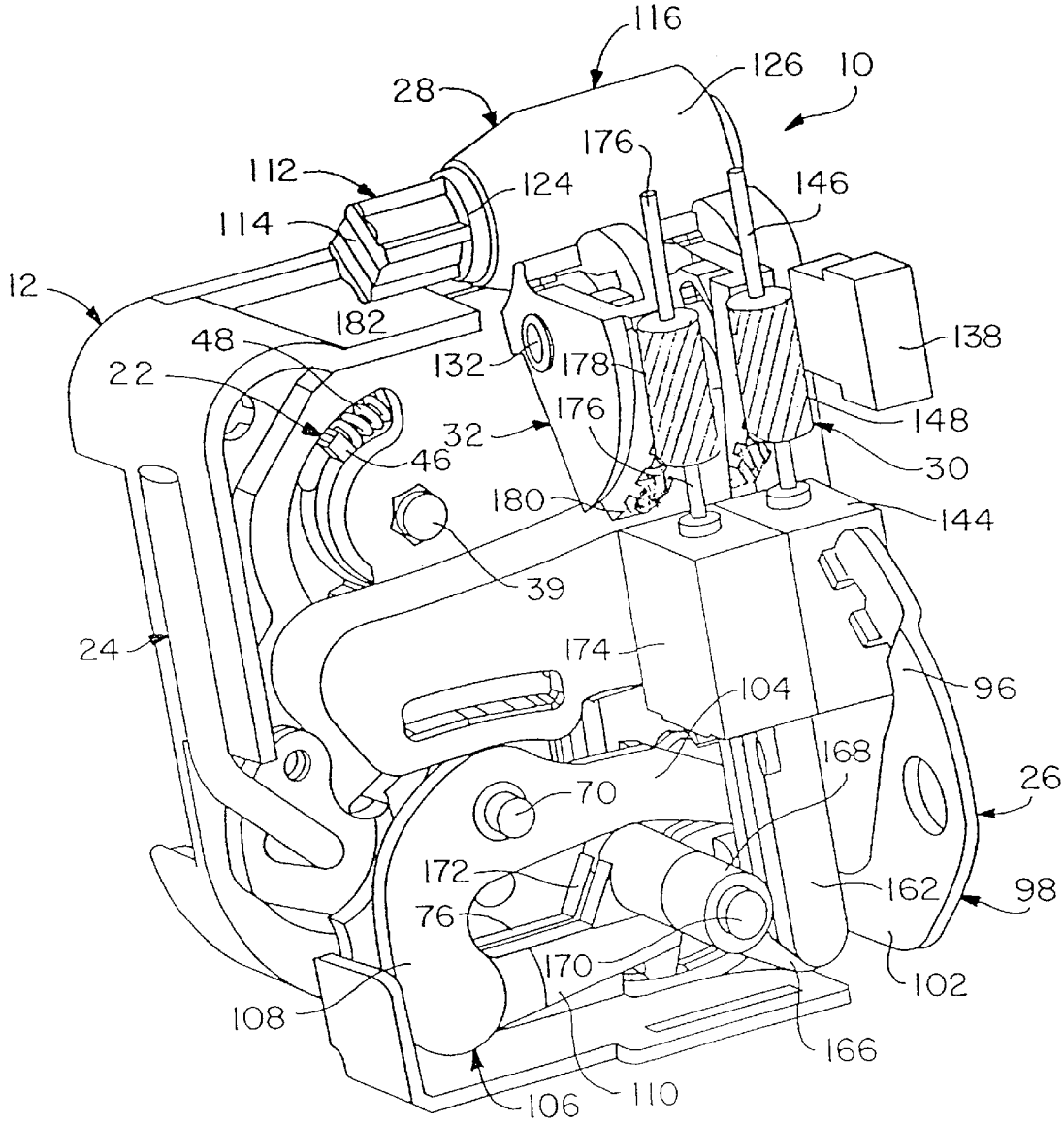
FIG. 4 is a perspective view looking in the opposite direction as the perspective of FIG. 3, with certain housing components being removed for purposes of clear illustration.
Figure 6:
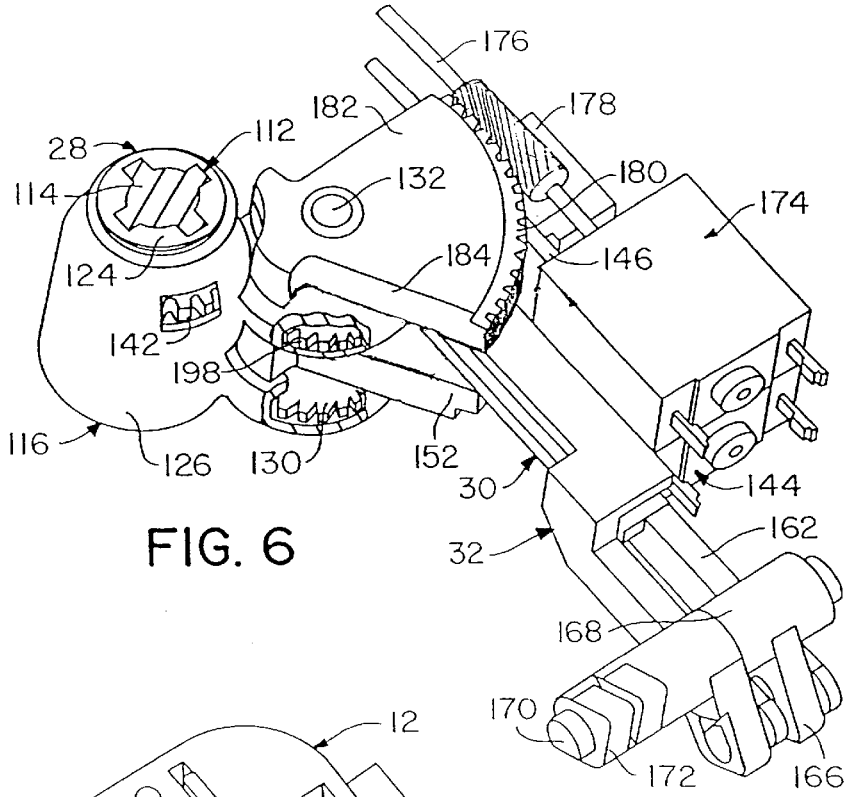
FIG. 6 is a view similar to FIG. 5, with the housing component removed, and portions of the gear housing being broken away to show the gears housed therein.
Figure 5:
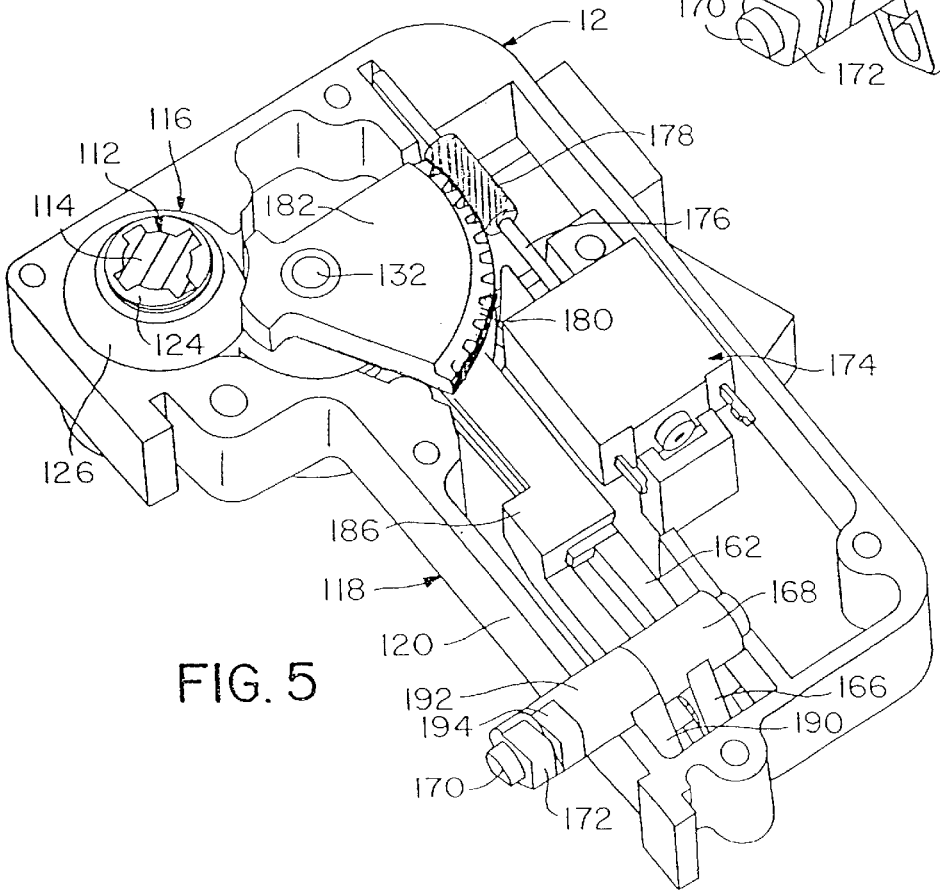
FIG. 5 is a perspective view of a housing component of the assembly shown in FIGS. 3 and 4 with the components associated therewith shown in contained relation therein.

The door latching assembly 22 includes a latching member, generally indicated at 38, which is pivotally mounted, as by a pivot pin 39, on the plate 36 for movement between a striker latching position and a striker releasing position. The latching member 38 is generally in the form of a U-shaped element with one leg 40 shaped to lead the striker 18 into a position between the legs and another leg 42 having a portion adapted to cooperate with a pivoted holding and releasing lever, generally indicated at 44, which constitutes an essential part of the door latching assembly 22. As best shown in FIG. 4, the latching member 38 includes a projection 46 on one side thereof which is adapted to engage a coil spring 48 which serves to resiliently bias the latching member 38 into its releasing position.

As best shown in FIGS. 10 and 11–14, the holding and releasing lever 44 includes a holding and releasing arm 50 which is engaged with one end of a coil spring 52, the opposite end of which is suitably fixed to the main housing sub-assembly 34. The spring 48 serves to resiliently bias the holding and releasing lever 40 into a holding position. The holding and releasing lever 40 is pivoted as by a pivot pin 54 to the main housing sub-assembly 34, in a position to extend the holding and releasing arm 46 thereof into a holding position to be engaged by the end of the leg 42 of the latch member 38 during the movement thereof from its releasing position into its locking position so as to pivot the holding and releasing lever 44 out of its holding position by the engagement thereof with the end of the leg 42 of the latching member 38 so that, as the end of the leg 42 passes beyond the free end of the holding and releasing arm 46, the latter will be biased into its holding position wherein the free end engages the end of the leg 42 of the latching member 38 and prevents the same from being moved out of its latching position.

The holding and releasing lever 44 also includes a releasing arm 56 having a laterally extending abutting portion 58 fixed thereon for cooperating with components of the outer door latch releasing mechanism 24 and the inner door latch releasing mechanism 26.

The outer door latch releasing mechanism 24 includes a conventional outer door manually actuated releasing assembly, generally indicated at 60, which includes the usual manual actuating member 62 which is manually movable from the exterior of the vehicle door 14. As best shown in FIG. 4, the outer manually actuated releasing assembly includes an interior connecting rod 64 which is moved downwardly when the outer door manual actuating member 62 is actuated. The end of the connecting rod 64 is pivotally connected with an arm 66 of a bell crank, generally indicated at 68, which also constitutes a component of the outer door latch releasing mechanism 24. The bell crank 68 is pivoted to the main housing sub-assembly 34, as by a pivot pin 70, which provides a pivotal axis parallel with the pivot axes provided by the pivot pins 39 and 54.

As best shown in FIGS. 11–14, bell crank 68 includes a second depending arm 72 which carries a pivot pin 74 parallel with the pivot pin 70 on which is pivotally mounted a releasing arm 76. The releasing arm 76 includes an upstanding portion 78 which is adapted to engage a stop structure 80 formed on the bell crank 68 between the arms 66 and 72. A spring 82 is coiled about the hub of the bell crank 68 and has one end connected with the main housing sub-assembly 34 and the opposite end connected with the upstanding portion 78 of the releasing arm 76 so as to bias the releasing arm 76 in a counter-clockwise direction as viewed in FIGS. 11–12 so that the upstanding portion 78 is biased into engagement with the stop structure 80 of the bell crank 68. The releasing arm 76 extends radially from the pivot pin 74 into a position so that a free end thereof will engage the abutting portion 58 of the releasing arm 56. When the bell crank 68 is pivoted in a counter-clockwise direction, as viewed in FIGS. 12–15, from the normal inoperative position, shown in FIG. 12, to the operative position, shown in FIG. 13, the releasing arm 56 moves the holding and releasing lever 44 from its holding position into its releasing position.

Figure 2:
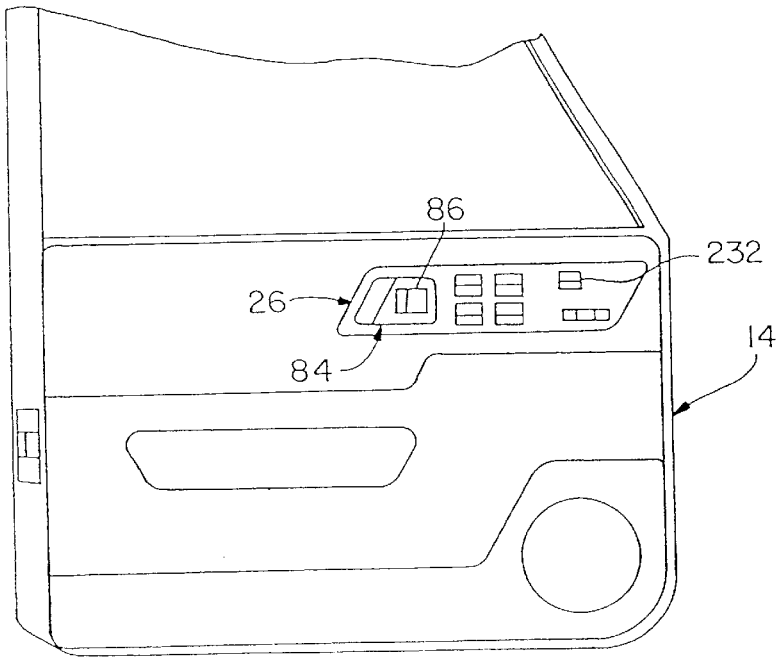
FIG. 2 is a fragmentary side elevational view of the inside driver's side door of the vehicle shown in FIG. 1.
Figure 10:
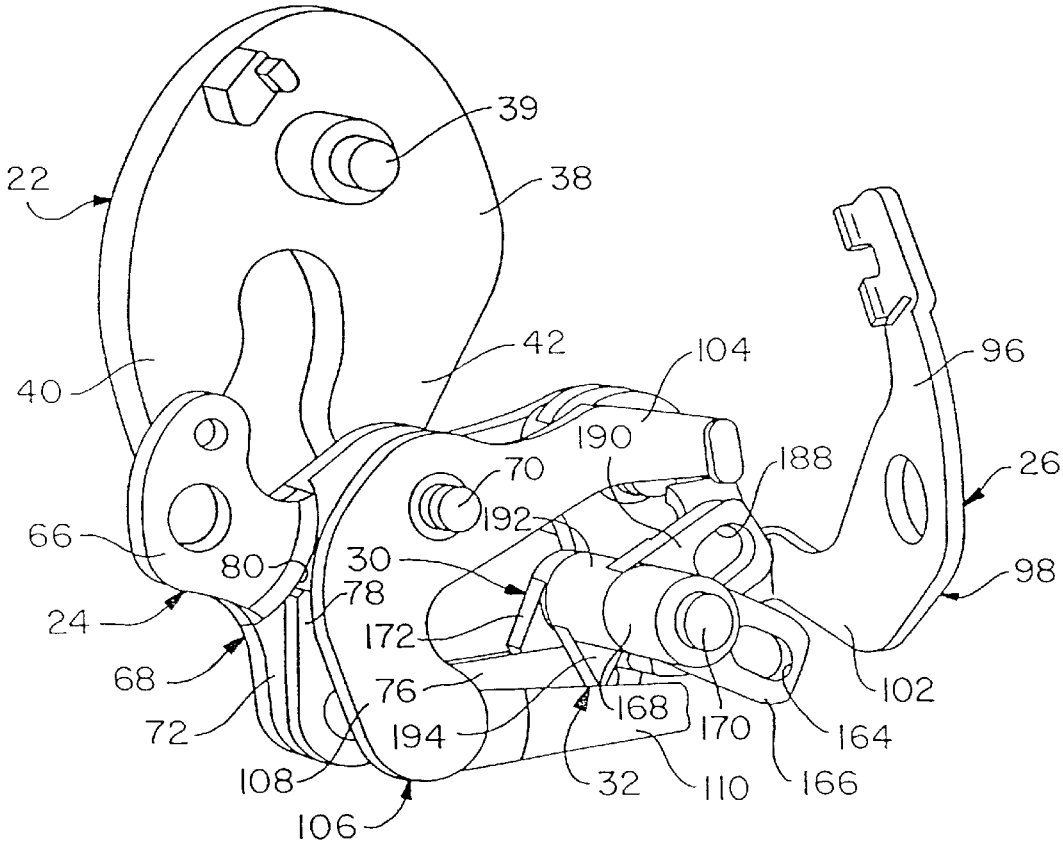
FIG. 10 is a perspective view showing the door latching and releasing assembly and the interface thereof with the key-actuated door locking assembly, the components of the outer door locking mechanism being shown in an unlocked position and the components of the inner door locking mechanism in a locked position.

As best shown in FIGS. 2, 3 and 10, the inner door releasing mechanism 26 includes the usual inner door manually actuated assembly, generally indicated at 84, which includes the usual manual actuating member 86 which is manually moved from inside the vehicle. The inner door manually actuated assembly 84 also includes an interiorly mounted Bowden wire assembly, generally indicated at 88, which includes an outer sheath 90, one end of which is suitably fixed to the main housing sub-assembly 34 as indicated at 92. The Bowden wire assembly 88 includes an inner cable 94 which extends outwardly from the end of the sheath 90 and has an end fixed to one arm 96 of a bell crank, generally indicated at 98. The bell crank 98 is pivoted to the main housing sub-assembly 24 as by a pivot pin 100 which provides a pivotal axis which is perpendicular to the pivotal axes provided by the pivot pins 39, 54 and 70.

The bell crank 98 includes a second arm 102 with an inwardly bent end which engages the end of an arm 104 of a bell crank, generally indicated at 106, which is of a similar construction to the bell crank 68 previously defined. The bell crank 106 is pivoted on the pivot pin 70 and includes a second depending arm 108 which carries a spring-biased pivoted releasing arm 110 which is similar to the releasing arm 76 previously described. The releasing arm 110 includes an outer end which likewise is disposed in a position to engage the abutting portion 58 of the releasing arm 56. The movement of the releasing arm 110 with the bell crank 106 has a similar effect on the holding and releasing lever 44 as the movement of the arm 56 as previously indicated.

The key actuated door locking and unlocking assembly 28, like the latch releasing mechanisms 24 and 26, include components which are essentially separate from the assembly 10. These components will vary depending upon whether the assembly 10 is mounted in a front or rear door 14. Front doors provide exterior key access while rear doors do not. However, rear doors do have manual locking capability when open and vehicle power is lost.

Figure 1:
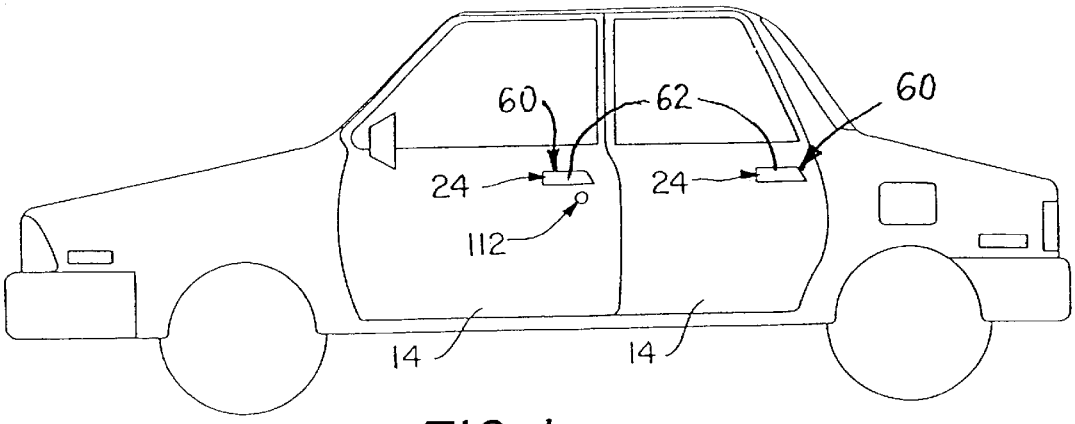
FIG. 1 is an exterior side elevational view of a four-door vehicle having incorporated therein an automatic vehicle door locking system with separate inner door and outer door locking mechanisms embodying the principles of the present invention.

FIG. 1 illustrates a conventional front door type key actuated actuating assembly, generally indicated at 112. The key actuating assembly 112 includes the usual key receiving turnable member and a lock cylinder arrangement which enables the turnable member to be turned only when a proper key is properly inserted. The turnable member, when turned, is connected to effect movement of an elongated longitudinally outwardly extending splined actuating shaft 114. The turnable member and shaft 114 are normally retained in a central key entering and exiting position. In accordance with usual practice. When the turnable member is turned in one direction, the turning action will effect a movement of the actuating shaft 114 which moves the key actuated door locking and unlocking assembly 28 from an unlocked mode into a locked mode. When the turnable member is turned from the key entering and exiting position in an opposite direction, this turning movement will effect a movement of the actuating shaft 114 which moves the key actuated door locking and unlocking assembly 28 from a locked mode into an unlocked mode.

The key actuated door locking and unlocking assembly 28 also includes an actuated assembly 116 which is carried by a secondary housing sub-assembly, generally indicated at 118. The secondary housing assembly 118 includes two cooperating housing parts 120 and 122 which are capable of being secured together and to the main housing sub-assembly 34. The actuated assembly 116 includes an annular member 124 which has its interior shaped to receive the splined actuating shaft 114 therein.

The annular member 124 is mounted within a housing 126 for pivotal movement, about an axis parallel with the axis provided by pivot pin 100. The housing 126 is, in turn, mounted within the secondary housing sub-assembly 118. One end of the annular member 124 has formed on the periphery thereof an annular series of gear teeth 128 which form essentially a gear on the annular member 124.

Figure 7:
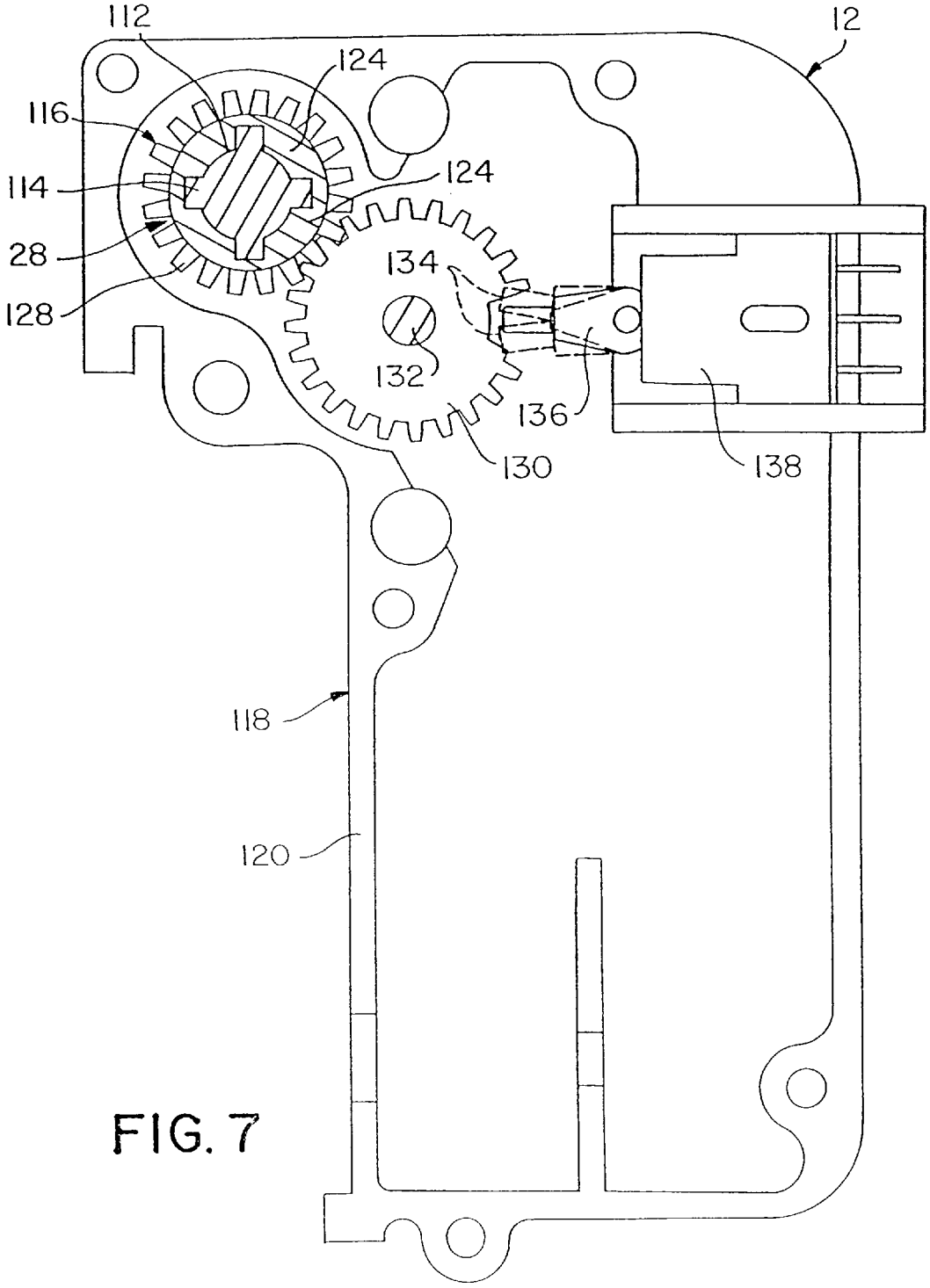
FIG. 7 is a view looking directly down into the housing component shown in FIG. 5 with all of the components therein removed except for the switch operating gear and the gear of the key assembly which meshes therewith.
Figure 8:
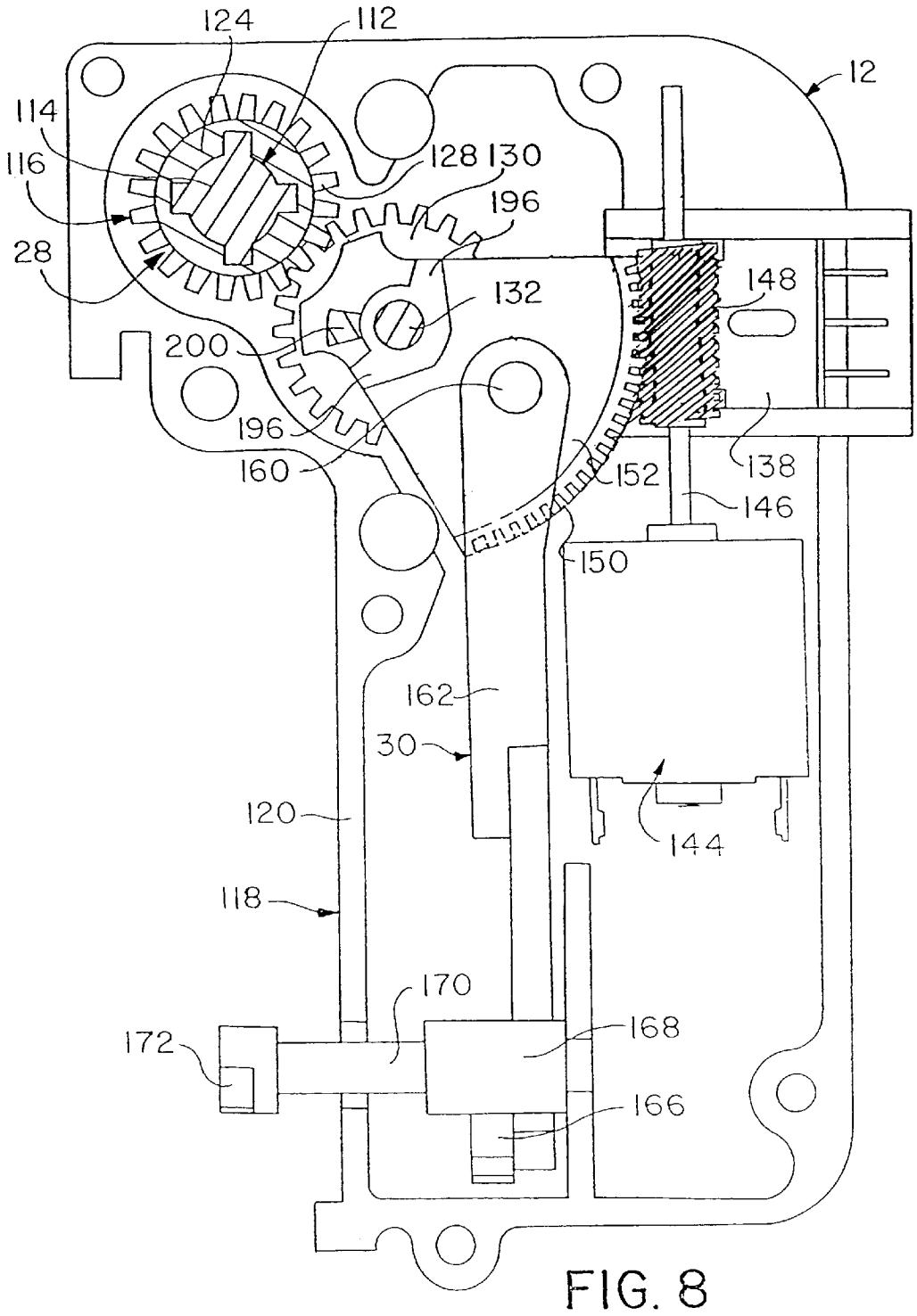
FIG. 8 is a view similar to FIG. 7 with the components of the outer door locking mechanism added and shown in an unlocked position.
Figure 9:
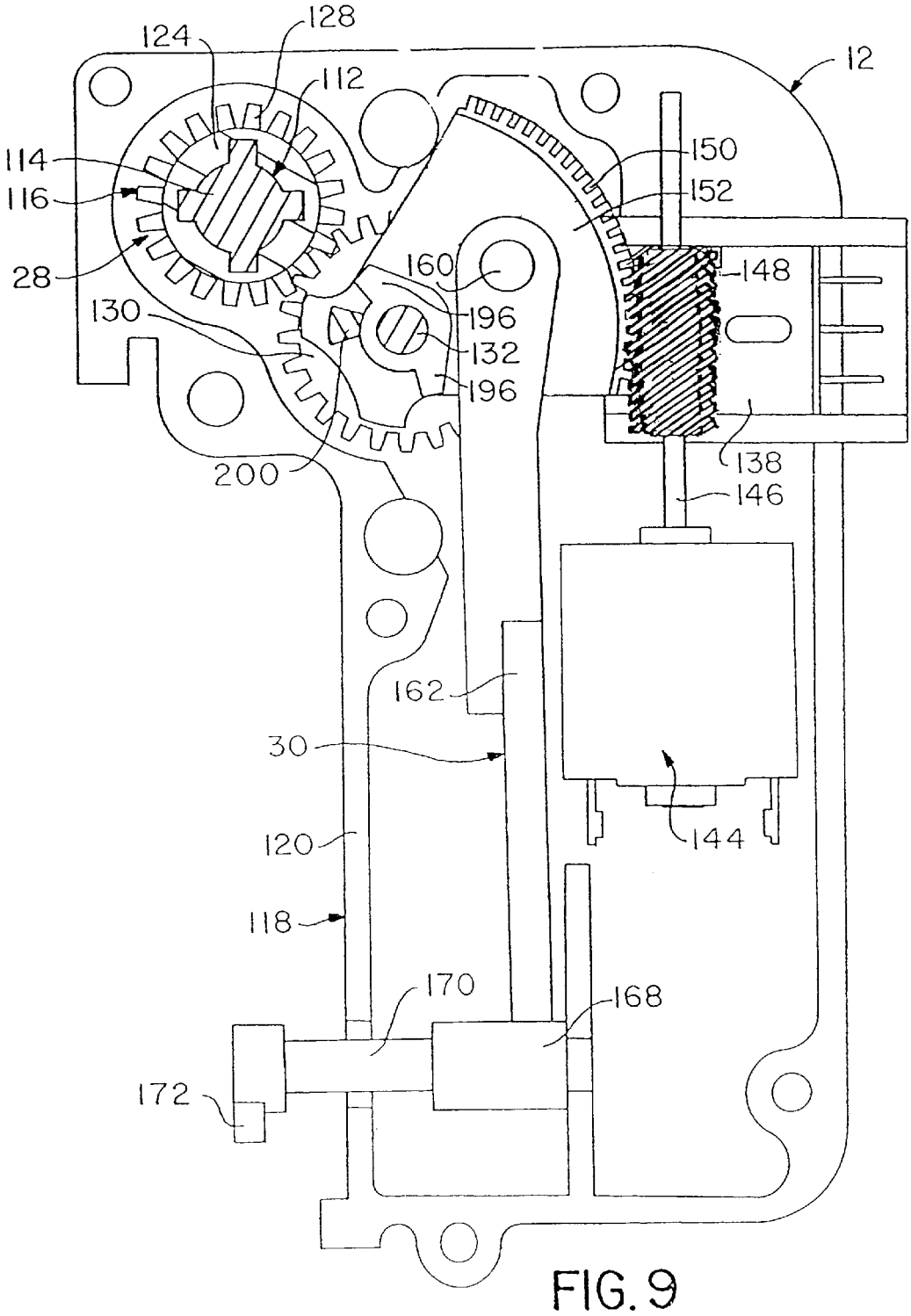
FIG. 9 is a view similar to FIG. 8 showing the components in a locked position.

As best shown in FIG. 7, the gear 128 meshes with a spur gear 130 rotatably mounted on a shaft 132 carried by the secondary housing sub-assembly part 120. The meshing spur gear 130 includes two peripheral annularly spaced abutting surfaces 134 which are adapted to engage an actuator arm 136 of an electrical switch assembly 138 suitably mounted in the secondary housing sub-assembly part 120. The switch assembly 138 is used in a locking system control circuit, generally indicated at 140, and shown in FIG. 16. The circuit 140 is, in turn, connected to control the power operated outer door locking mechanisms 30 and the power operated inner door locking mechanism 32.

The key actuated locking and unlocking assembly 28, while normally operating on a power basis through the switch assembly 138 and control circuit 140, also has the capability of manual operation in the event of a power downage. To this end, the annular member 124 includes a second series of teeth 142 spaced from the gear teeth 128 which form a second manual actuated gear, the operation of which will be explained hereinafter.

Referring now more particularly to FIGS. 6–9, the power operated outer door locking mechanism 30 is power operated by an electric motor which is generally indicated at 144. The electric motor 144 is mounted within the housing part 120 of the secondary housing sub-assembly 118. The electric motor 144 includes an output shaft 146 on which is mounted a worm gear 148. The worm gear 148 meshes with a series of teeth 150 formed on a sector gear member 152 which is pivotally mounted on the shaft 132 so as to pivot about the same axis as the gear 130. The worm gear 148 has a relatively large pitch such that it is not self-locking but is capable of being turned in reverse in response to a pivotal movement manually imparted to the sector gear member 152.

The sector gear member 152 has mounted thereon a pivot pin 160 at a position spaced radially from the pivot shaft 132. Mounted on the pivot pin 160 is one end of a connecting rod or member 162. The opposite end of the connecting member 162 has a pin extending transversely therefrom which engages within an elongated opening 164 formed in an arm 166 fixed to a collar 168. As shown, the collar 168 is, in turn, fixed to a shaft 170 which is suitably journalled between the housing sub-assembly parts 120 and 122, so as to pivot about an axis which is essentially parallel with the axes provided by the pivot pins 39, 54, and 70. Fixed to the opposite end of the shaft 170 is a cam 172 which is disposed in engagement with the actuating arm of the outer door releasing mechanism 24.

The power operated inner door locking mechanism 32 includes components which duplicate those of the power operated outer door locking mechanism 30. The power operated inner door locking mechanism 32 is power operated by a motor which is generally indicated at 174. The electric motor 174 is mounted adjacent the motor 144 and includes an output shaft 176 which is parallel with the shaft 146. The shaft 176 has mounted thereon a worm gear 178 which meshes with teeth 180 of a sector gear member 182. The sector gear member 182 is mounted on the same shaft 132 as the sector gear member 152 in spaced relation thereto and in a mirror image relationship thereto. The sector gear member 182 carries a pin similar to the pin 160 on which is pivotally mounted one end of a connecting member 186 which extends initially in parallel relation with the connecting member in the direction of the axis of the shaft and then extends around so as to be disposed in parallel relation with the outer end of the connecting member in the direction of the axis of the shaft. As before, the connecting member 186 includes a pin which is mounted within an elongated opening 188 in an arm 190 fixed to a collar 192. The collar 192 is pivotally mounted on the shaft 170 and includes a cam portion 194 on the opposite axial end thereof which is disposed in cooperating relation with the actuating arm 110 of the inner door releasing mechanism 26.

Each of the sector gear members 152 and 182 includes a hub portion having a pair of outwardly directed stop lugs 196. As before, the stop lugs 196 of the two sector gear members 152 and 182 are disposed in a mirror image relationship with respect to one another. Mounted on the shaft 132 between the hubs of the motion transmitting members 154 and 182 is a manual actuation gear 198 (see FIG. 6) which is disposed in meshing relation with the gear teeth 142 of the key assembly. Mounted on opposite sides of the gear 198 is a pair of projecting lugs 200 which are adapted to cooperate with the stop lugs 196 of the sector gear members 152 and 182 respectively.

Figure 11:
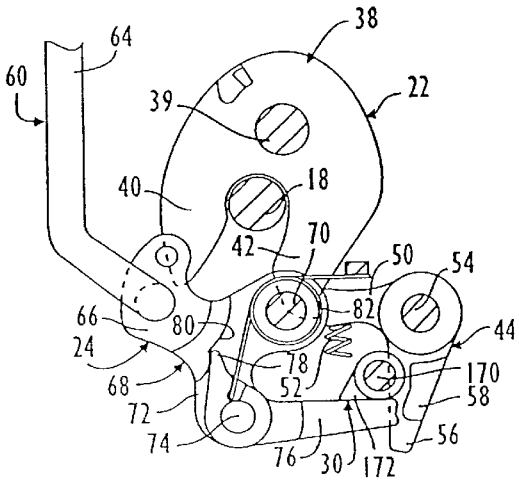
FIG. 11 is a view of the structure shown in FIG. 10, illustrating the outer door latch releasing mechanism and its interface with the outer door locking mechanism and with the inner door latch releasing mechanism and its interface with the inner door locking mechanism being removed, the parts being shown in an unlocked position.
Figure 12:
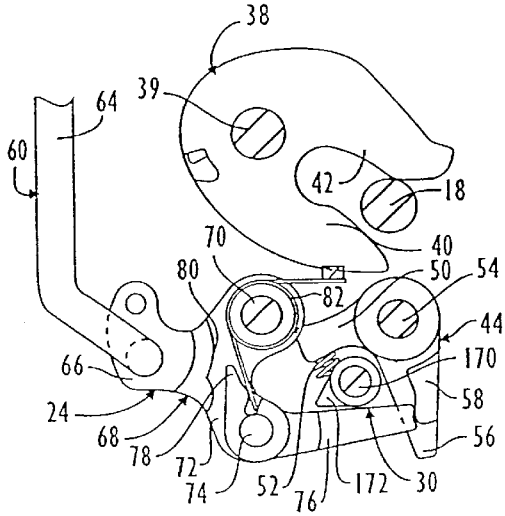
FIG. 12 is a view similar to FIG. 11 showing the components in a latch released position.

The manner in which the outer door locking mechanism 30 interacts with the door latching assembly 22 and the outer door latch releasing mechanism 24 is best illustrated in FIGS. 11–14. It will be understood that the cooperation of the inner door locking mechanism 32 with the door latching assembly 22 and inner door latch releasing mechanism 26 is similar to that of the outer door mechanisms as shown in FIGS. 11–14. FIG. 11 illustrates the condition of the door latching assembly 22 when the door 14 containing the assembly 10 is closed in latched relation. It will be noted that the striker 18 is captured between the legs 40 and 42 of the latching member 38 and that the latching member 38 is retained against movement by virtue of the holding arm 50 of the holding and releasing lever 44 disposed in its holding position engaging the outer end of the leg 42 of the latching member 38. The outer door latch releasing mechanism 24 is shown in FIG. 11 in its inoperative position wherein the free end of the actuating arm 76 is disposed in a position to engage the abutting portion 58 of the releasing arm 56 of the holding and releasing lever 44. It will be noted that the cam 172 of the outer door locking mechanism 30 is disposed in abutting relation with the upper surface of the actuating arm 76. When the various mechanisms are in the position shown in FIG. 11, the door 14 can be opened by actuating the outer door manual actuating assembly 112. FIG. 12 illustrates the position of the various mechanisms after the actuation has taken place.

It will be noted that the bell crank 68 has been pivoted about its pivot pin 70 and that the actuating arm 76 has thus been moved to the right as shown in FIG. 12 into engagement with the abutment portion 58 of the releasing arm 56 so as to pivot the holding and releasing lever 44 in a counterclockwise direction, as viewed in FIG. 12. During this movement, the holding arm 50 is moved out of engagement with the end of the leg 42 of the latching member 38 so that the latching member 38 is now free to pivot about pivot pin 38 in a counterclockwise direction allowing the door 14 to be opened. FIG. 11 shows the striker 18 just in its releasing position from the latching member 38.

Figure 13:
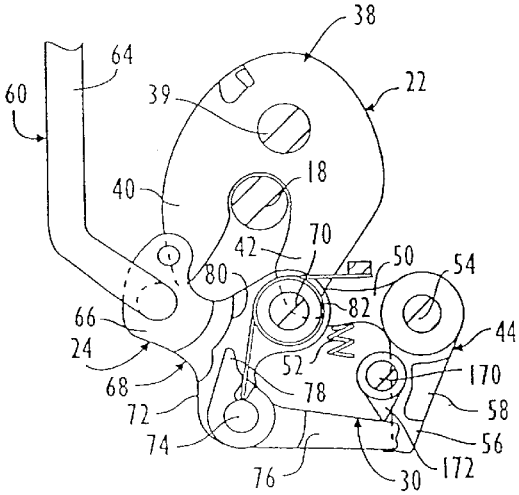
FIG. 13 is a view similar to FIG. 11 showing the components in a locked position.

FIG. 13 illustrates the position of the various mechanisms when the outer door locking mechanism 30 is moved from its unlocked mode or position to its locked mode or position. Essentially, it will be noted that the door latching assembly 22 is still in its closed latched position with respect to the door 14 and the outer door latch releasing mechanism 24 is still in its inoperative position. The only movement that has taken place is the turning of the cam 172 from its unlocked position as shown in FIGS. 11 and 12 to its locked position, as shown in FIG. 13. This movement of the cam 172 takes place in the counterclockwise direction, as viewed in FIG. 13, which has the effect of pivoting the actuating arm 76 downwardly against the bias of the spring 82. In this position, the door 14 is locked so that it cannot be opened from the outside without the outer door locking mechanism 30 being returned to its unlocked mode or position.

Figure 14:
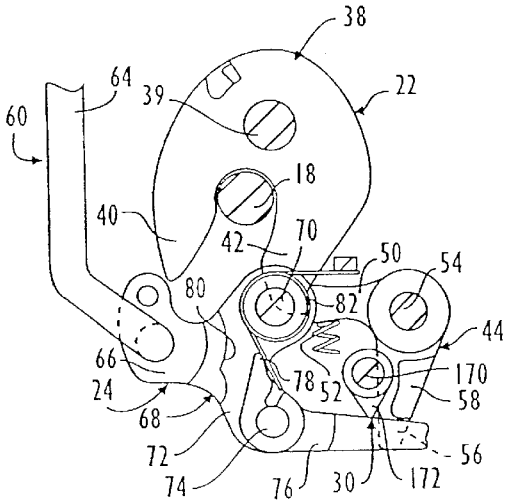
FIG. 14 is a view similar to FIG. 13 illustrating the position of the parts after the outer door actuating mechanism has been moved into its normal actuating position when the outer door locking mechanism is in its locked position.

FIG. 14 illustrates the position of the parts when the outer door latch releasing mechanism 24 is actuated when the outer door locking mechanism 30 is disposed in its locked mode position. In FIG. 12, the door latching assembly 22 is still in its door closed latching position and the outer door latch releasing mechanism 24 has been actuated so as to move the same through the same motion that occurs when a releasing action takes place, such as shown in FIG. 12. However, since the cam 172 is holding the actuating arm 76 in a position so that, when it moves forwardly, it will not engage the abutment portion 58 of the releasing arm 56 of the holding and releasing lever 44, there will be no movement of the latter into its releasing position but rather it will be retained in its holding position.

The manner in which the cam 172 of the outer door locking mechanism 30 is moved from its unlocked position, as shown in FIGS. 11 and 12, to its locked position, as shown in FIGS. 13 and 14, is best understood with reference to FIGS. 6–9. It will be understood that the operation of the inner door locking mechanism 32 is similar to that of the outer door locking mechanism 30 and hence a description of the one should suffice to provide an understanding of both.

As a convenience, the unlocked mode of the outer door locking mechanism 30 is chosen as a starting position. The first step is to engage a key within the key actuating mechanism 112 and to turn the same so that the spline actuating shaft 114 moves clockwise as viewed in FIG. 7. This movement is directly transmitted to the annular member 124 which, in turn, will cause a corresponding angular movement of the gear 130 by virtue of the gear teeth 128 meshing therewith. The movement of the gear 130 causes the abutment surface 134 to engage the switch arm 136 to actuate the switch 138. The manner in which the signal from the switch 138 is transmitted to the electric motor 144 will be described in detail hereinafter. Suffice it to say that a very small turn on the key by the operator will actuate the switch assembly 138 and also the electric motor 144. As soon as the electric motor 144 is energized, the shaft 146 turns carrying with it the worm gear 148. The meshing of the worm gear 148 with the teeth 150 of the sector gear member 152 causes the sector gear member 152 to pivot in a counter-clockwise position, as viewed in FIG. 8 about the shaft 132. As the sector gear member 152 moves its pivot pin 160 carries with it the connecting member 162 so that the latter is moved with an essentially transitional movement in a direction to pivot the shaft 170 in a counter-clock wise direction as viewed in FIGS. 4 and 10. This movement of the shaft 170 is accomplished by the engagement of the pin on the end of the connecting member 168 moving within the opening 164 so as to cause the arm 166 to move. Since the collar 168 is fixed to the arm 166 and to the shaft 170, the shaft 170 is therefore turned. The cam 172 is fixed to the shaft 170 to move therewith into the position shown in FIGS. 9, 13 and 14. Consequently, the movement of the cam 172 will affect a locking action with respect to the outer door releasing mechanism 24 and the door latching assembly 22 in the manner previously stated. The movement of the outer locking mechanism 30 from its locked position into its unlocked position starts with a reverse key movement and concludes with a repeat of the functional movements noted above in reverse.

FIG. 10 also illustrates a movement of the outer door locking mechanism 30 into the locked position thereof by a manual movement of the key, such as when a power shut-off to the vehicle has occurred. It can be seen that, if the small angular movement of the key necessary to actuate the switch 38 does not result in a power actuated movement of the outer door locking mechanism 30 from its unlocked position into its locked position, the operator can continue to turn the key manually which will have the effect of continuing to move the annular member 124. It will be noted that the turning movement of the member 124 not only serves to rotate the gear 130 by virtue of the meshing gear teeth 128 on the member 124 but, in addition, the other set of gear teeth 142 on the member 124 will cause a turning of the gear 198 which carries the projecting lugs 200. The gear 198 and lugs 200 move during a normal power operated movement but not enough to engage the stop lugs 196 on the sector gear members 152 and 182. The greater amount of angular movement of the member 124 which occurs in a manual manipulation without power will be enough not only to engage the stop lugs 196 but to move the sector gear members 152 and 182 after engagement has taken place. The sector gear members 152 and 183 can move because the pitch of the worm gears 148 is such that a reverse drive is possible. Since the motor 144 is not powerized shaft 146 will allow the worm gear to turn in response to the manual movement of the sector gear member 152. The movement of the sector gear members 152 and 182 above has the same effect as when the gear sector members 152 and 182 are moved by the motors 144 and 174; namely, the cams 172 and 194 move between unlocked and locked positions depending upon the direction of manual key movement.

Figure 15:
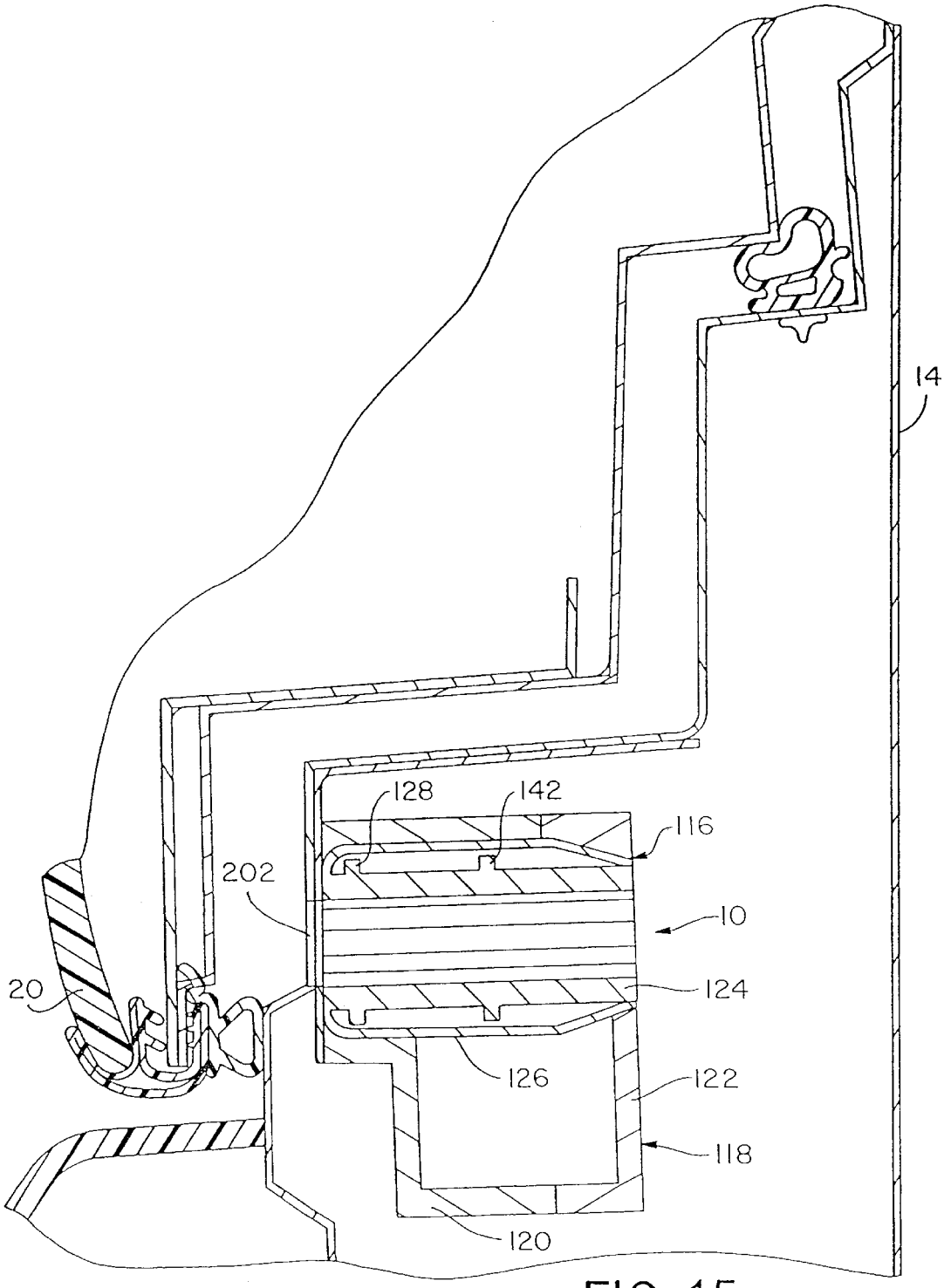
FIG. 15 is a cross-sectional view taken along the line 15—15 of FIG. 3 showing the vehicle key-actuated door locking assembly installed in a closed rear vehicle door.

As was previously indicated, it is contemplated that only the two front doors of a four door sedan would be equipped with a key actuating assembly 112 which interfaces with the actuating assembly 116. FIG. 15 illustrates the installation of the unit 10 in a rear door 14 of a four door car which is essentially the same for both rear doors. Specifically, FIG. 15 shows how the actuated assembly 116 of the unit 10 is made available for use in locking the rear door in the event of a power failure. As shown in FIG. 15, the unit 10 is mounted in the door 14 so that the splined interior of the member 124 is accessible through an opening 202 formed in the interior of the door 14 at a position which is covered by the door frame 20 when the door is closed. In the event of a vehicle power failure at a location where it would be necessary to have the vehicle unattended while seeking help, it would be possible to manually lock the front doors with a key actuation in the manner previously described. If the power failure occurred with the rear doors unlocked, it would be possible to lock each of them by simply opening each door and then engaging the key through the opening 202 and into the interior splines of the member 124 and affecting a manual turning action which will have the effect of moving the outer door locking mechanism 30 into its locked position in the manner previously described. Thereafter, when the door 14 is closed, it will remain locked.

Figure 16:
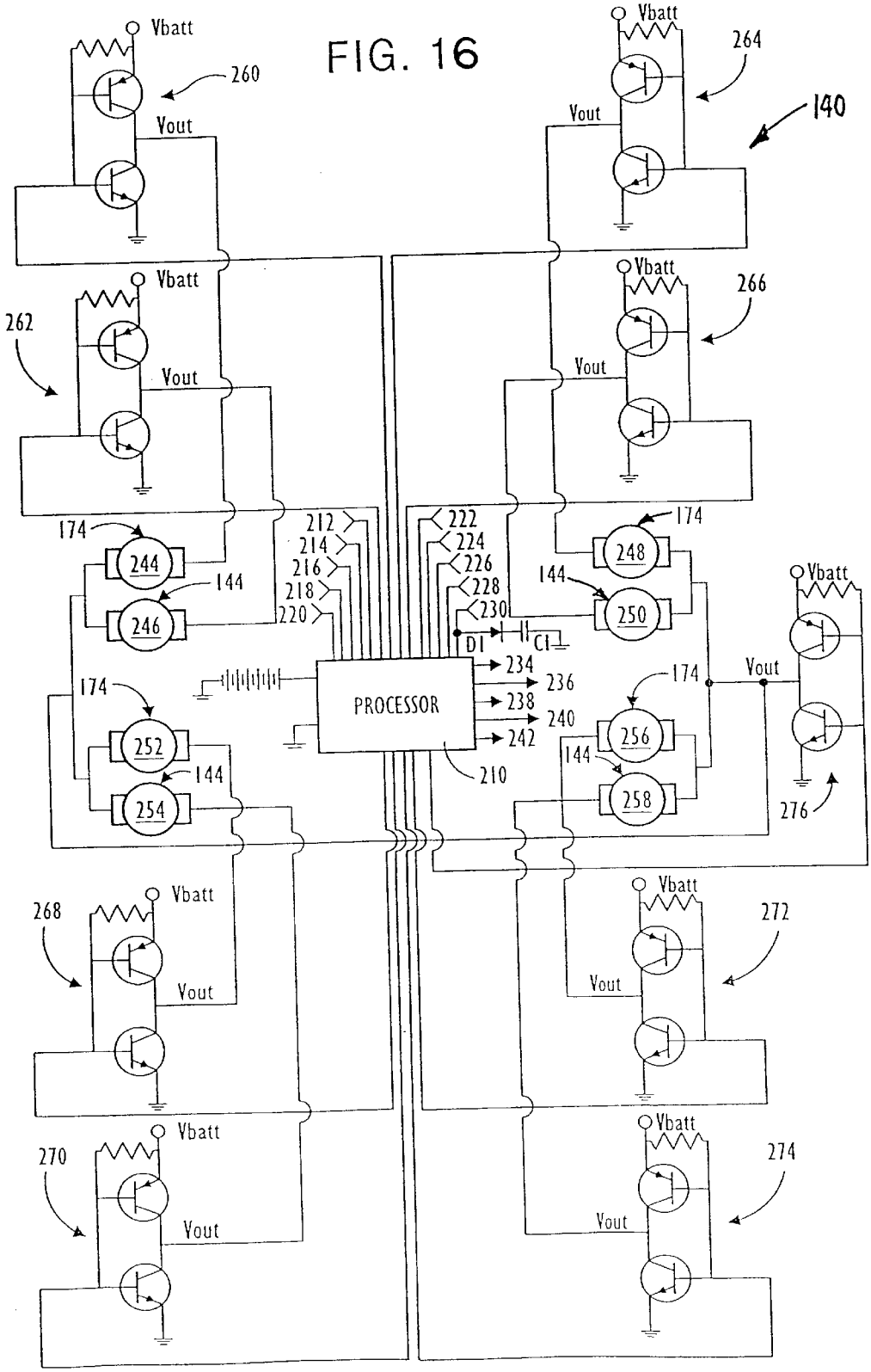
FIG. 16 is a schematic wiring diagram of an electrical control circuit for automatically controlling the automatic vehicle door locking system of the present invention.

Referring more particularly to FIG. 16, processor 210 receives inputs from the various sensors and switches of the vehicle door locking system, on signal lines 212–230. Signals on lines 212 indicate the state of the inside lock switches of, for example, the front doors. In a preferred embodiment of the present invention only the front doors have inside lock switches, such as 232 shown in FIG. 2 for the front driver side door. As an alternative, another embodiment of the present invention includes only one inside lock switch position on the front console or in place of, for example, the switch 232 shown in FIG. 2.

Signal line 214 provides the PRNDL signal from the gear shift. This signal indicates whether or not the vehicle is, for example, in park (P), reverse (R), neutral (N), drive (D) or low (L). Signal lines 216 provide inputs from the key FOB. Typically the signals are "LOCK" or "UNLOCK." Signal lines 218 provide the signals from key switches, such as 138 shown in FIG. 7. Typically, there is one such key switch associated with each key lock for the vehicle doors. Commonly, only the two front doors have such key switches. Signal line 220 provides an input from the child lock switch (discussed below) indicating whether or not the rear doors are in the child lock or state.

Signal lines 222, 224, 226 and 228 provide inputs from the door ajar sensors. The signals indicate whether or not the respective front left, rear left, front right or rear right doors are fully closed or are ajar. Signal line 230 is an input from the vehicle crash sensor. This signal is activated when the vehicle crash sensor senses that the vehicle has crashed.

Output signals 234–242 drive various indicator lamps in the vehicle. For example, in an embodiment of the present invention, signal 234 drives a front left door ajar lamp; signal 236 drives a front right door ajar lamp; signal 238 drives a rear left door ajar lamp; and 240 drives a rear right door ajar lamp. Signal 242 drives a lock status lamp which is discussed below.

As shown in FIG. 16, the processor 210 drives a set of motors 244–258. For example, the motor 244 can correspond to the inner motor 174 shown in FIG. 6, and the motor 246 can correspond to the outer motor 144 shown in FIG. 6. In a similar manner, motor 248 drives the front right inside handle lock, while motor 250 drives the front right outside handle lock. In a corresponding manner, motor 252 drives the rear left inside handle lock and motor 254 drives the rear left outside handle lock. Finally, motor 256 drives the rear right inside handle lock and motor 258 drives the rear right outside handle lock.

As shown in FIG. 16, motor drive circuits 260–274 drive corresponding ones of the motors 244–258. While FIG. 16 illustrate transistor pair motor drivers, any suitable motor driver can be used in accordance with the present invention, depending upon the drive requirements of the motor. Transistor pair 276 establishes the reference polarity for each of the motors 244–258; and in turn the rotational direction of each of these motors.

In one embodiment of the present invention, the processor 210 shown in FIG. 16 provides the following functions. When the processor 210 senses that an inside lock switch, such as 242 shown in FIG. 2, is in the lock position, then the processor would move, for example, motor 246 to place the outside handle in a lock position; where the motor 246 could correspond to, for example, motor 144 shown in FIG. 6. If the processor 210 determines that an inside lock switch, such as 232 is in the unlock position, then the processor 210 reverses the state of transistor pair 276 and moves motor 246 to unlock the outside door handle. In the case of only one inside lock switch located in, for example, a front console, then upon sensing the inside lock switch in the lock position, the processor would place each of the outside motors in the lock position. Upon sensing the inside lock switch in the unlock state, then the processor 210 would unlock each of the outside handles as outlined below. In doing so, the processor 210 drives, for example, motor driver 260 to move motor 244. Depending upon the type of motor employed, the transistor driver 260 drives the motor for approximately 0.2 seconds or until the limit switch confirms that the motor 244 has moved, for example, gear 182 by a sufficient amount.

The PRNDL signals are provided by a sensor that is commonly available in many of today's modern vehicles. When the processor 210 senses that the shift lever is moved out of park, each of the outside handles is placed in a lock position following the lock procedure as described below. Alternatively, the outside handles can be locked whenever the PRNDL signal indicates that the shift lever is moved into the drive position.

The following describes the processor 210 operation in response to receiving signals from the key FOB. Typically a key FOB includes two buttons: LOCK and UNLOCK. The processor 210 can control the vehicle entry system in any number of ways in response to the key FOB signals. The following describes one such manner of operation. When the processor 210 detects that the key FOB LOCK button has been pressed once, the processor proceeds through a lock procedure. In particular, processor 210 places the transistor pair 276 to a logic one state (i.e., $V_{out}$ approximately equals $V_{vatt}$). Each of the inside motor driver (e.g., 260, 264, 268 and 270) are placed the same state as the transistor pair 276, that is, a logic 1. Each of the motor drivers for the outside handles (e.g., 262, 266, 270 and 274) are placed in the opposite state as the transistor pair 276. This supplies a drive voltage to each of the corresponding motors. This drive voltage is applied for approximately 0.2 seconds or until a limit switch as described above detects that the motor has caused the appropriate movement. The motor drivers for each of the outside door handles is then placed at the same potential as the transistor pair 276, i.e., a logic 1. In this state, the potential across the respective motor is approximately 0 volts.

When processor 210 detects that the key FOB LOCK button has been pushed twice, then all door handles, inside and outside, are locked. To accomplish this, the processor 210 performs the same function as when the key FOB LOCK button is pressed once, with the addition of each motor driver for the inside door handles being placed in the logic 0 state (i.e., a potential opposite that of the transistor pair 276) for the 0.2 seconds or until a limit switch determines that the corresponding motor has moved the desired gear the appropriate amount.

When processor 210 detects that the key FOB UNLOCK button is depressed once, the processor 210 will unlock the driver's side door, both inside and outside handles. To effect this operation within the system shown in FIG. 16, the processor 210 places the transistor 276 in a logic 0 state, the driver side inside and outside motor drivers (e.g., motor drivers 260 and 262) are then placed in a state opposite to that of the motor driver 276, e.g., a logic 1 state. To ensure that none of the other motors move during this operation, the processor 210 can set the motor drivers for all of the other motors to the same state as the transistor pair 276. The processor 210 allows the driver's side inside and outside handle motors to move for approximately 0.2 seconds, or until the appropriate limit switch detects that the corresponding gear has moved the desired amount. After the expiration of the desired amount of time or upon receipt of appropriate signal from a limit switch, the processor 210 changes the driver side motor drivers (e.g., 260 and 262) to the same state as the transistor pair 276; that is, to a logic 0 state. This function unlocks the driver's side inside and outside locks.

When the processor 210 detects that the key FOB UNLOCK button has been depressed twice, the processor 210 unlocks the inside and outside door handles for each of the doors. To effect this operation, the processor 210 places the transistor pair 276 in a logic 0 state. The processor 210 then places the rear drivers 260–274 in a state opposite that of the transistor pair 276; that is, a logic 1 state. This condition is held for approximately 0.2 seconds, or until the limit switches, if any, indicate that the respective motors have moved the appropriate gears by the desired amount. After the lapse of the appropriate time or detection of the limit switch signals, the processor changes the state of each of the motor drivers 260–274 to the same potential as the transistor pair 276, that is, a logic 0 state. This sequence unlocks all of the vehicle doors.

The processor 210 also senses operation of a key via switch 138 such as shown in FIG. 7, via signals on lines 212. If the key cylinder is moved in the lock direction once, then the outside handle for the corresponding door is locked. To accomplish this, the processor drives the associated motor drivers and transistor pair 276 as discussed above with respect to the lock operation. The key cylinder is turned in the lock direction twice, then the processor will lock all of the vehicle doors. To effect this operation, the processor performs the operations such as described with respect to the key FOB when the key FOB LOCK button is pressed twice. If the key cylinder is rotated once in the unlock direction, then the processor 210 will drive the corresponding motor driver to unlock the outside lock associated with the key being moved. To effect this operation, the processor drives the motor driver and transistor pair 276 to unlock the door as described above.

Activation of the child lock switch causes the processor 210 to lock the inside rear door handles. To effect this operation, the processor first places the transistor pair 276 in the logic 1 (i.e., lock state). The motor drivers for the front inside handles and the rear outside handles are also placed in the same state as the transistor pair 276; that is, the logic 1 state. The motor drivers for the inside handle of the rear doors (i.e., 272, 274) are then placed in the opposite state as the transistor pair 276; that is, in the logic 0 state. The processor maintains this condition for 0.2 seconds or until the appropriate limit switch indicates that the inside handle drive motors have moved the appropriate gears the desired amount. After the lapse of the appropriate time or reception of the limit switch input, the processor 210 changes the state of the rear motor drivers (272, 274) to have the same potential as the transistor pair 276; that is, the logic state 1.

When the processor 210 detects that the child lock switch has been turned off, the processor operates to unlock the inside rear doors. To effect this operation, the processor 210 first places the transistor pair 276 in the unlock, logic 0 state. The motor drivers for the front inside handles (260, 264) and each outside motor driver (262, 266, 270 and 274) are placed in the same potential as the transistor pair 276; that is, the logic 0 state. The processor maintains this condition for approximately 0.2 seconds (or until the appropriate limit signal is received). Following this, the processor changes the state of the motor drivers for each rear door inside handle (268, 272) to have the same potential as the transistor pair 276; that is, the logic 0 state.

The appearance of a door ajar signal on one of the signal lines 222, 224, 226 or 228 causes the processor 210 to unlock the door associated with the door ajar signal. For example, if the front left door ajar signal is received on line 222, then the processor 210 unlocks the outside lock door handle for the front left door. The processor also lights the corresponding door ajar lamp.

Referring to FIG. 16, a crash sensor applies a signal on line 230 to processor 210. As shown in FIG. 16, the crash sensor signal slowly charges C1 through D1. In the event of a crash being detected by the crash sensor, the charge stored on capacitor C1 is sufficient to allow the processor to unlock all outside door handles. To effect the unlock operation, the processor follows the unlock sequence of operations as discussed above. The lock status signal on line 242 indicates the lock state of the associated door. For example, in a preferred embodiment of the present invention, each front door would have its own lock status lamp driven by a separate signal on line 242. When the associated door has both the inside and outside door handles locked, the lock status lamp flashes at a low rate (e.g., 1 Hz) for ten minutes upon startup of the vehicle. If only the inside door is locked, then the lock status light for that door remains on as long as the PRNDL signal indicates that the vehicle is not in the parked condition; and remains on for an additional period of time (e.g., 10 seconds) when the vehicle is placed in the park state.

The above description of the present invention as embodied in the circuit of FIG. 16 can also be embodied using relays instead of the motor drivers. In such a case, the one end of the relay coils would be driven by, for example, a signal such as Vout that is provided by transistor pair 276 in the case of the FIG. 16 embodiment. The other side of each relay coil would be driven by the appropriate output from the processor depending upon the door with which that relay coil is associated.

Figure 17:
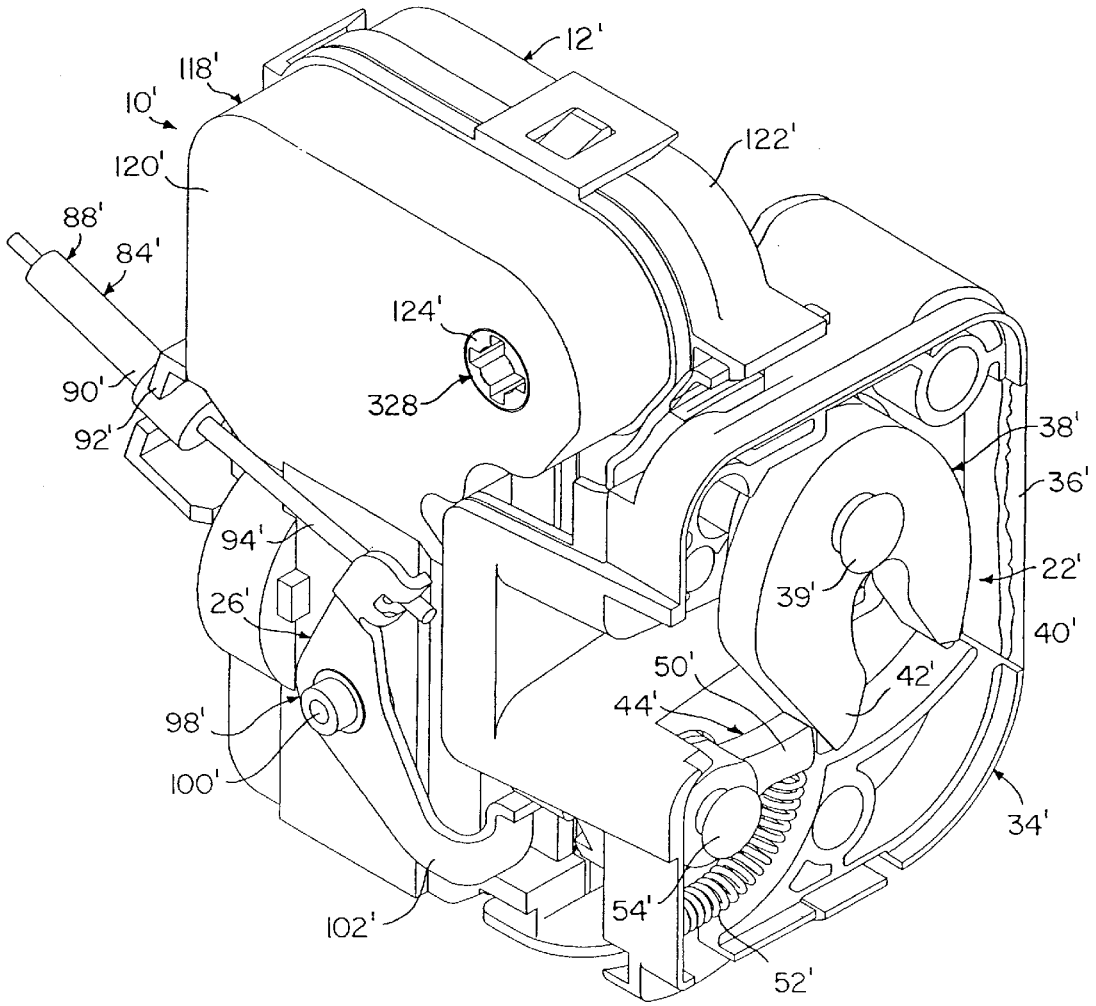
FIG. 17 is a perspective view similar to FIG. 3 of a modified power operated vehicle door locking assembly embodying the principles of the present invention.
Figure 18:
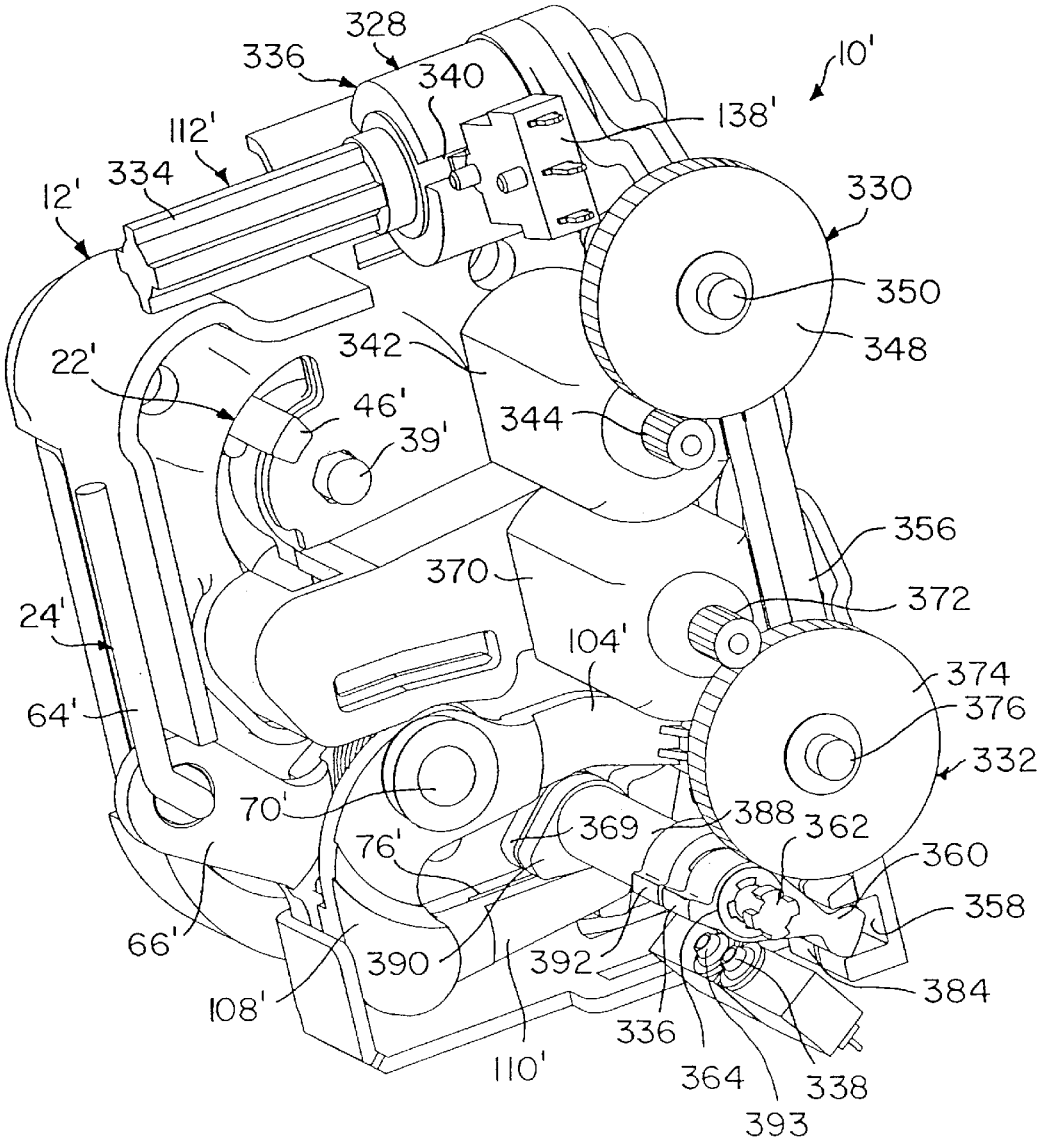
FIG. 18 is a perspective view similar to FIG. 4 of the door locking assembly shown in FIG. 17.

Referring now more particularly to FIGS. 17 and 18 of the drawings, there is shown therein a modified power operated vehicle door locking assembly which embodies the principles of the present invention. The modified door locking assembly of FIGS. 17 and 18 has been designated generally by the numeral 10' since it contains many components which are identical with the components of the door locking assembly 10 and these common identical components have been designated by the same numerals with an added prime where included in FIGS. 17–24 illustrating the door locking assembly 10'. The common basic components of the door locking assembly 10' include the housing assembly, generally indicated at 12', the door latching assembly, generally indicated at 22', the outer door latch releasing mechanism, generally indicated at 24', and the inner door latch releasing mechanism, generally indicated at 26'. The construction and operation of these components are like those of the comparable components previously described and their construction and operation need not be repeated. The component which is varied in the door locking assembly 10' is the key-actuated door locking and unlocking assembly, generally indicated by the new reference numeral 328, which includes a separate power operated outer door locking mechanism, generally indicated at 330, and a separate power operated inner door locking mechanism, generally indicated at 332.

The construction and operation of the key actuated door locking and unlocking assembly 328 will vary depending upon whether the assembly 10' is mounted in a front or rear door. Front doors provide exterior key access while rear doors do not. However, rear doors do have manual locking capability when open and vehicle power is lost.

When the key actuated door locking and unlocking assembly 329 is used in a front door, the front door will include a conventional front door type key actuated actuating assembly. The key actuating assembly includes the usual key receiving turnable member and a lock cylinder arrangement which enables the turnable member to be turned only when a proper key is properly inserted. The turnable member, when turned, is connected to effect movement of an elongated longitudinally outwardly extending splined actuating shaft, illustrated at 334 in FIG. 18. The turnable member and shaft 334 are normally retained in a central key entering and exiting position. In accordance with usual practice. When the turnable member is turned in one direction, the turning action will effect a movement of the actuating shaft 334 which moves the key actuated door locking and unlocking assembly 328 from an unlocked mode into a locked mode. When the turnable member is turned from the key entering and exiting position in an opposite direction, this turning movement will effect a movement of the actuating shaft 334 which moves the key actuated door locking and unlocking assembly 328 from a locked mode into an unlocked mode.

The key actuated door locking and unlocking assembly 328 also includes an actuated assembly 336 which is carried by a secondary housing sub-assembly, generally indicated at 118'. The secondary housing assembly 118' includes two cooperating housing parts 120' and 122' which are capable of being secured together and to the main housing sub-assembly 34'. The actuated assembly 336 includes an annular member 338 which has its interior shaped to receive the splined actuating shaft 334 therein.

The annular member 338 is mounted within the housing 118' for pivotal movement, about an axis parallel with the axis provided by pivot pin 100'. One end of the annular member 338 has formed on the periphery thereof two annularly spaced abutting surfaces 340 which are adapted to engage an actuator arm 136' of an electrical switch assembly 138' suitably mounted in the secondary housing sub-assembly part 120'. The switch assembly 138' is used in the locking system control circuit 140, as shown in FIG. 16. The circuit 140 is, in turn, connected to control the power operated outer door locking mechanisms 330 and the power operated inner door locking mechanism 332.

The key actuated locking and unlocking assembly 328, while normally operating on a power basis through the switch assembly 138' and control circuit 140, also has the capability of manual operation in the event of a power downage.

Referring now more particularly to FIGS. 17–23, the power operated outer door locking mechanism 330 is power operated by an electric motor 342. The electric motor 342 is mounted within the housing part 120' of the secondary housing sub-assembly 118'. The electric motor 342 includes an output shaft on which is mounted a small spur gear 344. The spur gear 344 meshes with a mating relatively large spur gear 348 which is rotatably mounted on a shaft 350 mounted in the housing sub-assembly 118' with its axis parallel to the axis of the output shaft of the motor 342. Fixed to the large spur gear 348 is a pinion gear 352 which, in turn, meshes with rack teeth 354 formed on a motion transmitting member 356.

Motion transmitting member 356 is mounted within the housing sub-assembly 118' for reciprocating movement between limiting positions. As best shown in FIG. 18, the end of the motion transmitting member 356 opposite from the end on which the rack teeth 354 are formed includes a bifurcation defining a recess 358. Extending into the recess 358 is an appropriately shaped end of an arm 360, fixed to a shaft 362, as by an integral collar 364.

The shaft 364 is suitably journalled between the housing sub-assembly parts 120' and 122', so as to pivot about an axis which is essentially parallel with the axes provided by the pivot pins 39', 54' and 70'. Fixed to the collar 364 is an actuation tab 366 which activates a cam position switch assembly 368. Fixed to the opposite end of the shaft 362 is a cam 369 which is disposed in engagement with the actuating arm 76' of the outer door releasing mechanism 24'.

The power operated inner door locking mechanism 332 includes components which duplicate those of the power operated outer door locking mechanism 330. The power operated inner door locking mechanism 332 is power operated by a motor 370. The electric motor 370 is mounted adjacent the motor 342 and includes an output shaft which is parallel with the output shaft of the motor 342. Mounted on the output shaft of the motor 370 is a spur gear 372 which meshes with a mating larger spur gear 374. The larger spur gear 374 is rotatably mounted on a shaft 376 which is parallel to the shaft 350. As before, a pinion 378 is fixed to the large spur gear 374, which, in turn, meshes with rack teeth 380 formed on a motion transmitting member 382 mounted for reciprocating movement in side-by-side relation with the motion transmitting member 356. As before, the motion transmitting member 382 includes a recess 384 which receives an end of an arm 386 fixed to a collar sleeve 388 pivotally mounted on the shaft 362. The collar 388 includes a cam portion 390 on the opposite axial end thereof which is disposed in cooperating relation with the actuating arm 110' of the inner door releasing mechanism 26'. The arm 386 also has an activation tab 392 which activates a switch assembly 393.

The manner in which the outer and inner door locking mechanisms 330 and 332 interact with the door latching assembly 22' and the outer and inner door latch releasing mechanism 24' and 26' is the same as previously described, since the movement of the cams 369 and 390 are the same as cams 172 and 194. The only difference is in the specific transmission of the movement of the motors to the cams. That is, meshing spur gears and a rack and pinion set are used instead of meshing worm and sector gears and a pivoted connecting member.

Referring now more particularly to FIGS. 20, 24, 25 and 26, these figures illustrate the interrelation between the annular member 338 of the actuated assembly 336 and the power operated outer and inner door locking mechanisms 330 and 332 and more particularly the manner in which the manual turning of the annular member 338 by the shaft 334 can effect manual movements of the outer and inner door locking mechanisms 330 and 332 when the source of electricity on the vehicle is no longer available, as by the battery going dead.

The annular member 338 includes a lower portion which is essentially cylindrical but has a pair of diametrically opposed integral moving lugs or elements 392 extending radially outwardly from the exterior periphery thereof. Mounted on the lower tab containing portion of the annular member 338 are outer and inner moving arms 394 and 396 respectively. One end of the outer moving arm 394 is in the form of a collar whose interior periphery engages the cylindrical exterior periphery of the annular member 338 and has diametrically opposed recesses formed therein to receive the turning lugs 392 therein. The recesses are bounded at one end by lug abutting surfaces 398 and at the other by lug abutting surfaces 400. The other end of the outer moving arm 394 is shaped to pivotally move within a confining recess 402 formed in the adjacent end of the outer motion transmitting member 356.

In a similar manner, the inner moving arm 396 has one end shaped as a collar with a dual recessed interior periphery. The recesses are bounded by lug engaging surfaces 404 and 406. The opposite end of the inner moving arm 396 is shaped to pivotally move within a confining recess 408 formed in the adjacent end of the inner motion transmitting member 382.

Figure 19:
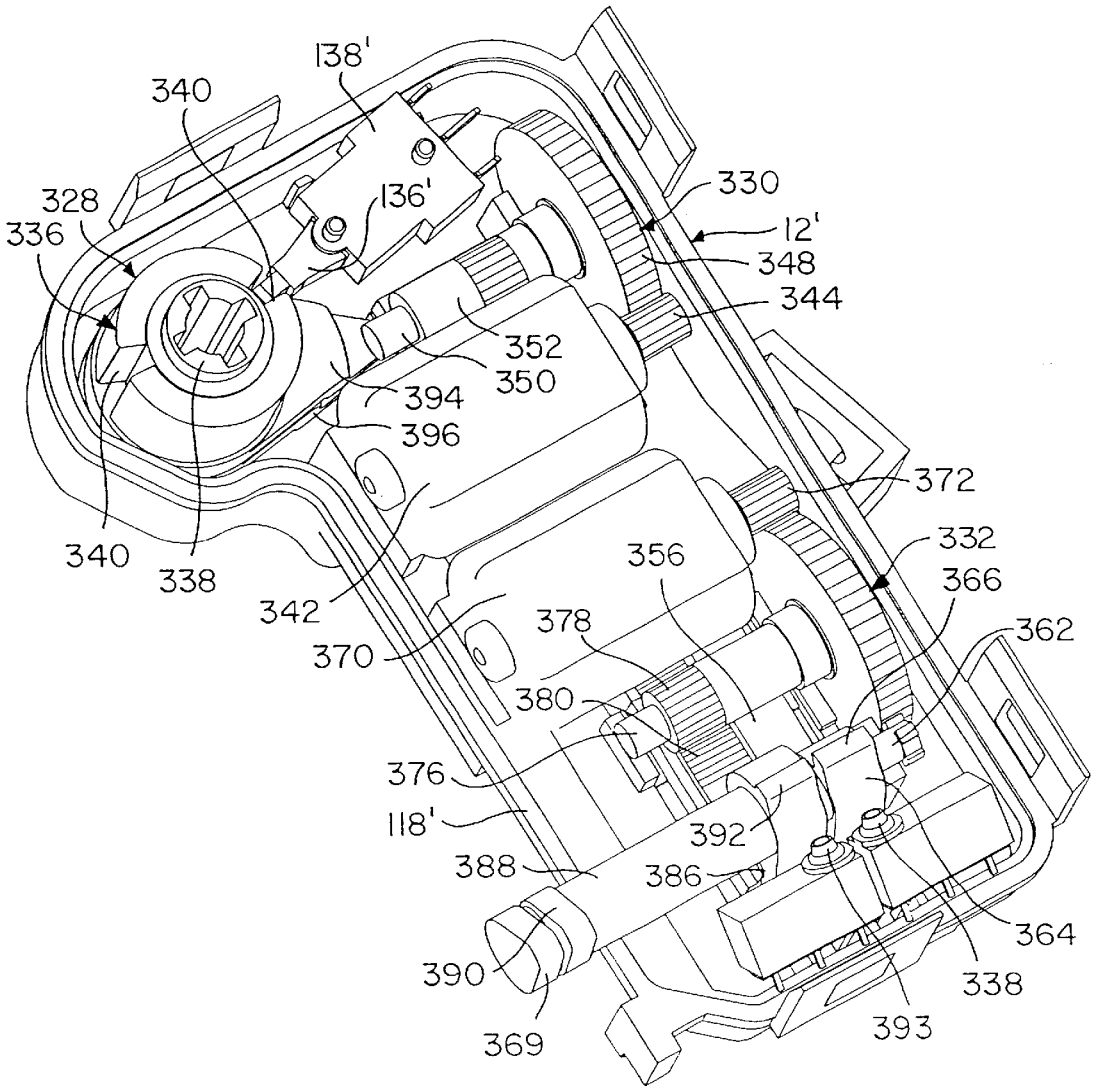
FIG. 19 is a perspective view similar to FIG. 5 of the assembly shown in FIG. 17, illustrating the parts in an outside and inside unlocked position.
Figure 20:
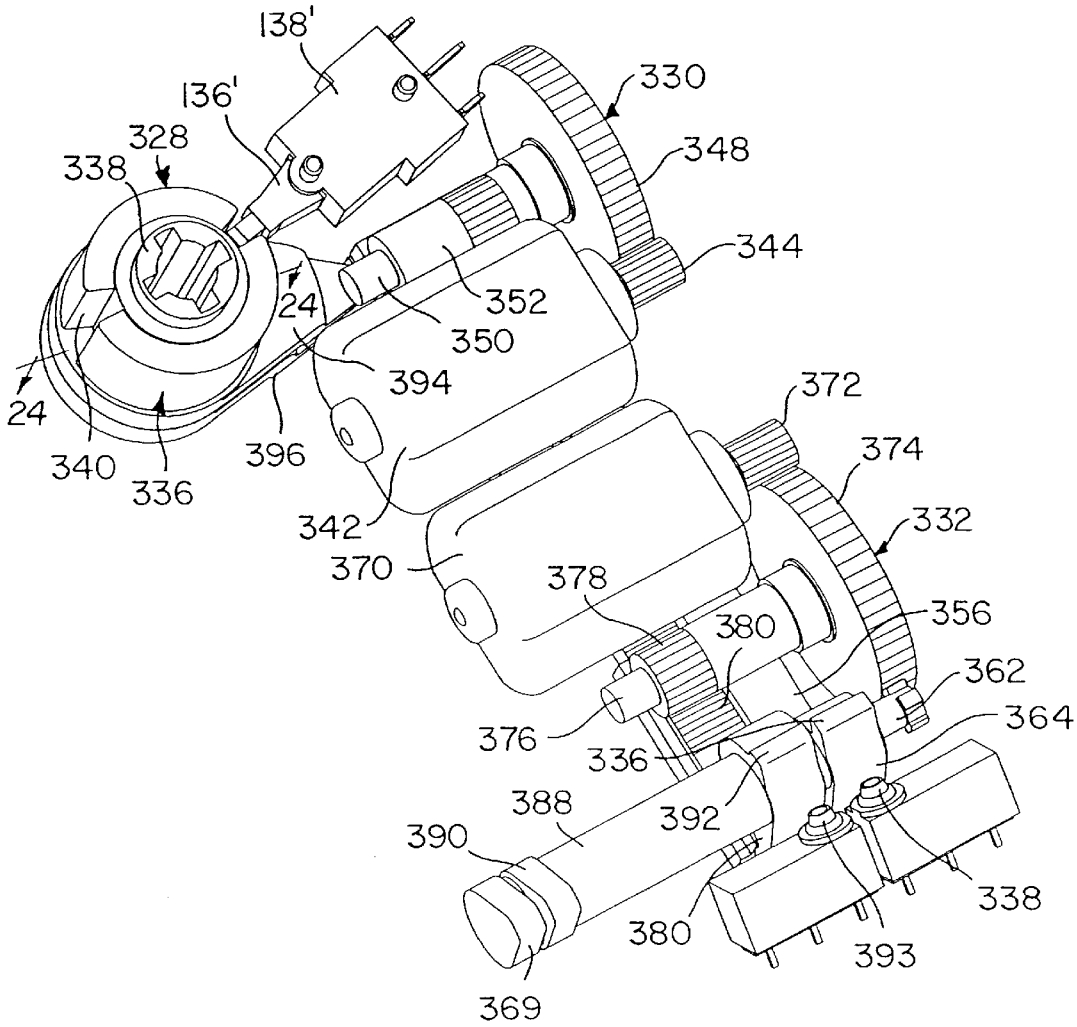
FIG. 20 is a view similar to FIG. 6 of the door locking assembly of FIG. 17, illustrating the parts in an outside and inside unlocked position.
Figure 21:
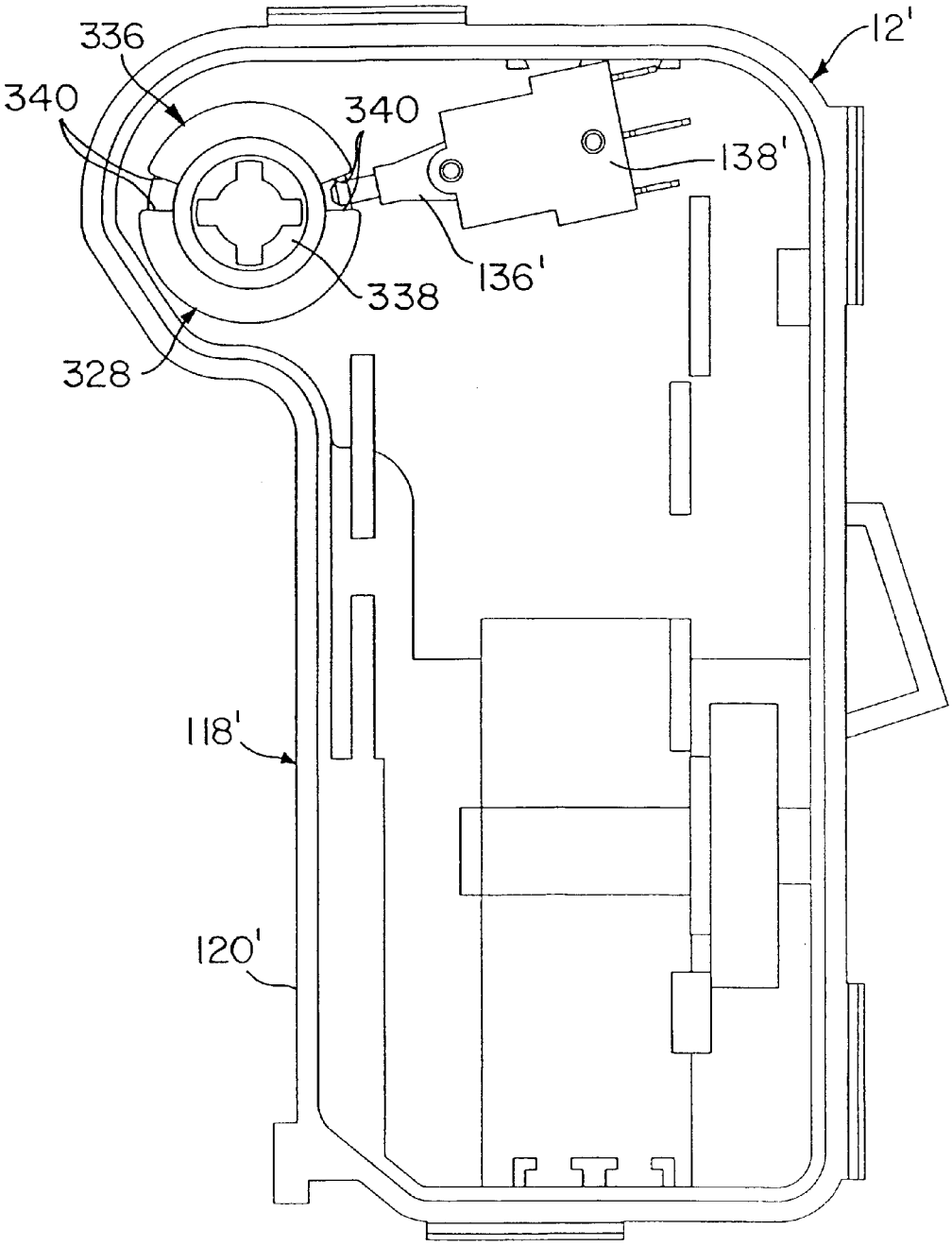
FIG. 21 is a view similar to FIG. 7 of the door locking assembly of FIG. 17, illustrating the parts in an outside and inside unlocked position.
Figure 22:
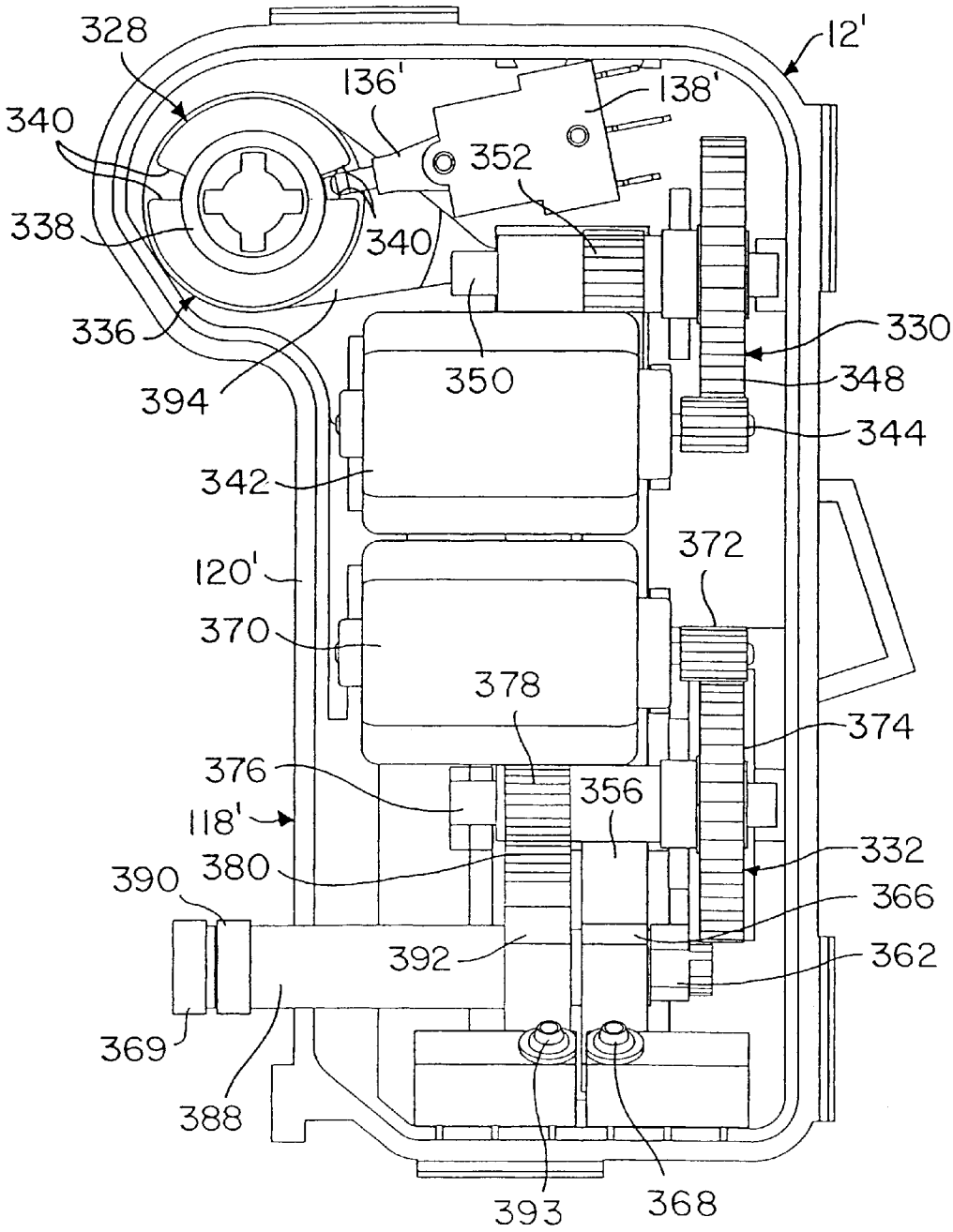
FIG. 22 is a view similar to FIG. 8 of the door locking assembly of FIG. 17, illustrating the parts in an outside and inside unlocked position.
Figure 23:
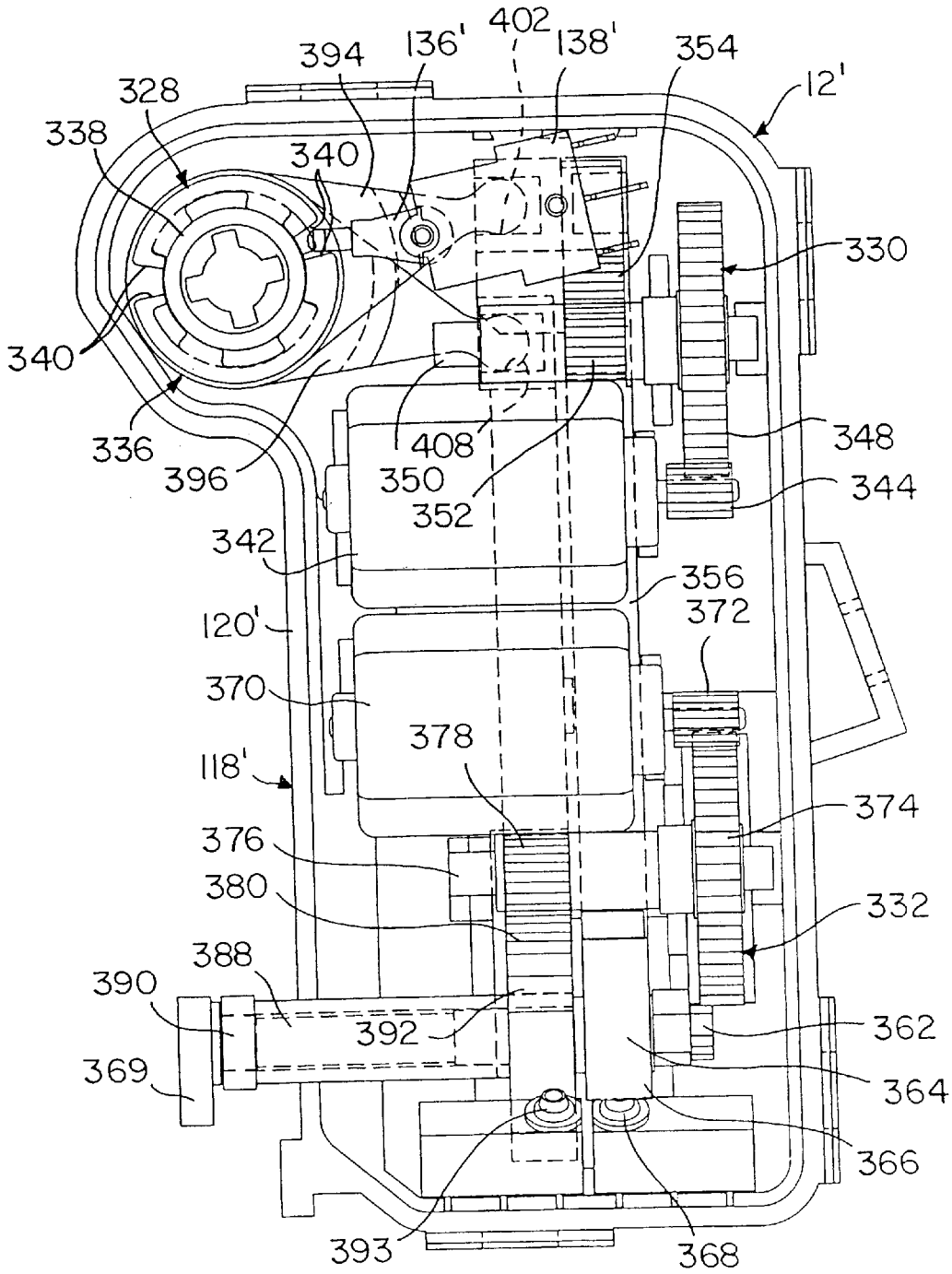
FIG. 23 is a view similar to FIG. 22, illustrating the parts in an outside and inside unlocked position.
Figure 24:
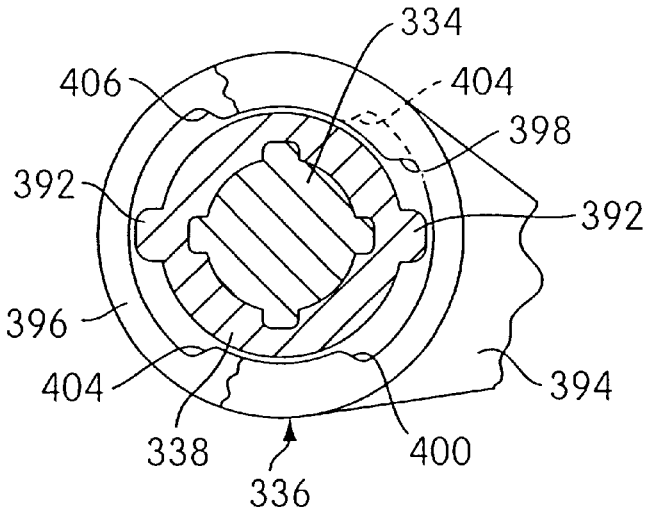
FIG. 24 is an enlarged fragmentary sectional view taken along the line 24—24 of FIG. 20 with the parts shown in an outside and inside unlocked position, with parts broken away for clearness of illustration.
Figure 25:
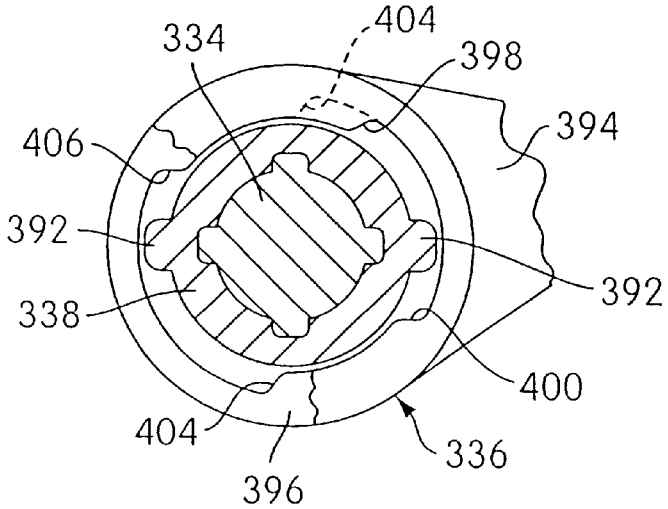
FIG. 25 is a view similar to FIG. 24 with the parts shown in an outside and inside locked position, with parts broken away for clearness of illustration.

FIG. 24, like FIGS. 19 and 20, illustrates the moving arms 394 and 396 in the unlocked positions thereof. FIG. 25 shows the arms 394 and 396 in the locked position thereof. It will also be noted that the annular member 338 is in a position which corresponds with the central key entering and exiting position of the normal turnable member of the key actuation assembly. It will be noted that the lugs 392 are disposed within a central portion of the recesses spaced from the recess defining surfaces 398, 400, 404 and 406. As shown in FIG. 24, the lug engaging surfaces 400 and 406 of the outer and inner moving arms 394 and 396 respectively are in alignment whereas the surfaces 398 and 404 are spaced from one another. It will also be noted that the annular member 338 can be turned slightly in either direction from the center key entering and exiting positions shown without engaging a lug engaging surface. During this movement, the switch 138' will normally be actuated so that the power operation of the power operated door locking mechanisms 330 and 332 will complete their movement without further manual movement of the annular member 338 or, in other words, further key turning movement by the operator.

In the event that the source of electricity for energizing the motors 342 and 370 is lost, as for example, by the battery going dead, the moving arms 394 and 396 can be used to move both the outer and inner door locking mechanisms 330 and 332 from the locked position thereof shown in FIG. 25 into the unlocked position thereof shown in FIG. 24. This movement can take place by a clockwise movement of the annular member 338 as viewed in FIG. 25. It will be noted that, after a few degrees of movement, the lugs 392 will engage the aligned lug engaging surfaces 400 and 406 so as to thereafter effect a movement of both of the moving arms 394 and 396 with the movement of the annular member 338. The engagement of the outer ends of the arms 394 and 396 within the recesses 402 and 408 within the motion transmitting members 356 and 382 will effect a movement of the latter from the locking positions thereof into the unlocking positions thereof. In this regard, it will be noted that the motors 342 and 370 will free-wheel as will the spur gears 344, 348, 372 and 374 as well as the pinions gears 352 and 378 thus allowing the manual movement to take place.

Figure 26:
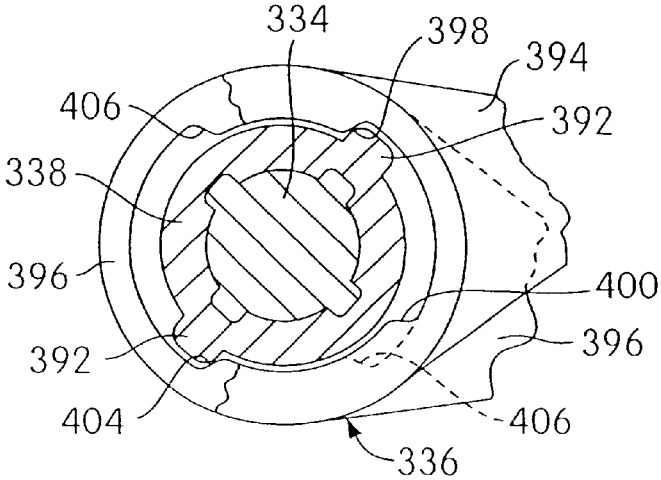
FIG. 26 is a view similar to FIG. 25 showing the parts after they have been manually moved from the unlocked position shown in FIG. 24 so that the outside is locked and the inside is unlocked.

FIG. 24 illustrates the position of the arms 394 and 396 after they have been moved into the locked positions thereof and the annular member 338 has been moved back into a position corresponding to the central key entering and exiting position of the key actuating assembly. In this position, it will be noted that a turning movement of the annular member 338 in a counterclockwise direction will have the effect of bringing the lugs 392 into engagement with the lug engaging surfaces 398 of the outer moving arm 394 so that further movement of the annular member 336 will effect movement of the outer arm 394 from its unlocked position into a locked position wherein the lug engaging surfaces 398 will align with the lug engaging surfaces 404. This condition is shown in FIG. 26. Consequently, in this embodiment, the manual override is capable of moving only the outer locking mechanism 330 into a locked position and not the inner locking mechanism 332.

It will be understood that the circuit system shown in FIG. 16 is utilized with the embodiment described above with respect to FIGS. 17–26. The switches 368 and 393 are used in the circuit only as monitoring switches to determine that the movement into a locking position has taken place. The de-energization of the motors 342 and 370 is still accomplished in the same fashion.

Referring now more particularly to FIGS. 27–35, there is shown therein another door locking assembly embodying the principles of the present invention. The modified door locking assembly of FIGS. 27 and 28 has been designated generally by the numeral 10" since, as before, it contains many components which are identical with the components of the door locking assembly 10. These common identical components have been designated by the same numerals with an added double prime where included in FIGS. 27–34 illustrating the door locking assembly 10". The common basic components of the door locking assembly 10" include the housing assembly, generally indicated at 12", the door latching assembly, generally indicated at 22", the outer door latch releasing mechanism, generally indicated at 24", and the inner door latch releasing mechanism, generally indicated at 26". The construction and operation of these components are like those of the comparable components previously described and their construction and operation need not be repeated. The component which is varied in the door locking assembly 10" is, as before, the key-actuated door locking and unlocking assembly, generally indicated by the new reference numeral 528, which includes a separate power operated outer door locking mechanism, generally indicated at 530, and a separate power operated inner door locking mechanism, generally indicated at 532.

The construction and operation of the key actuated door locking and unlocking assembly 528 will vary, as before, depending upon whether the assembly 10" is mounted in a front or rear door. Front doors provide exterior key access while rear doors do not. However, rear doors do have manual locking capability when open and vehicle power is lost. In this embodiment, the rear doors are capable of being locked on the inside and not on the outside whereas this capability is not used on the front doors.

As before, when the key actuated door locking and unlocking assembly 532 is used in a front door, the front door will include a conventional front door type key actuated actuating assembly. The key actuating assembly includes the usual key receiving turnable member and a lock cylinder arrangement which enables the turnable member to be turned only when a proper key is properly inserted. The turnable member, when turned, is connected to effect movement of an elongated longitudinally outwardly extending splined actuating shaft, illustrated at 534 in FIG. 28. The turnable member and shaft 534 are normally retained in a central key entering and exiting position. In accordance with usual practice. When the turnable member is turned in one direction, the turning action will effect a movement of the actuating shaft 534 which moves the key actuated door locking and unlocking assembly 528 from an unlocked mode into a locked mode. When the turnable member is turned from the key entering and exiting position in an opposite direction, this turning movement will effect a movement of the actuating shaft 534 which moves the key actuated door locking and unlocking assembly 528 from a locked mode into an unlocked mode.

The key actuated door locking and unlocking assembly 528 also includes an actuated assembly 536, similar to the assembly 336. The actuated assembly 535 includes an annular member 537, which has formed on the periphery thereof two annularly spaced abutting surfaces 541 adapted to engage an actuator arm 136" of an electrical switch assembly 138". The switch assembly 138" is used in the locking system control circuit 140". The control circuit 140" is, in turn, connected to control the power operated outer door locking mechanisms 530 and the power operated inner door locking mechanism 532.

The key actuated locking and unlocking assembly 528, while normally operating on a power basis through the switch assembly 138" and a control circuit 140", also has the capability of manual operation in the event of a power downage.

A basic difference in the vehicle door locking assembly 10" from the assemblies 10 and 10' resides in the utilization of a single motor 536 in the electric control system 140" to supply the power to both the outer door locking mechanism 530 and the inner door locking mechanism 532.

Figure 27:
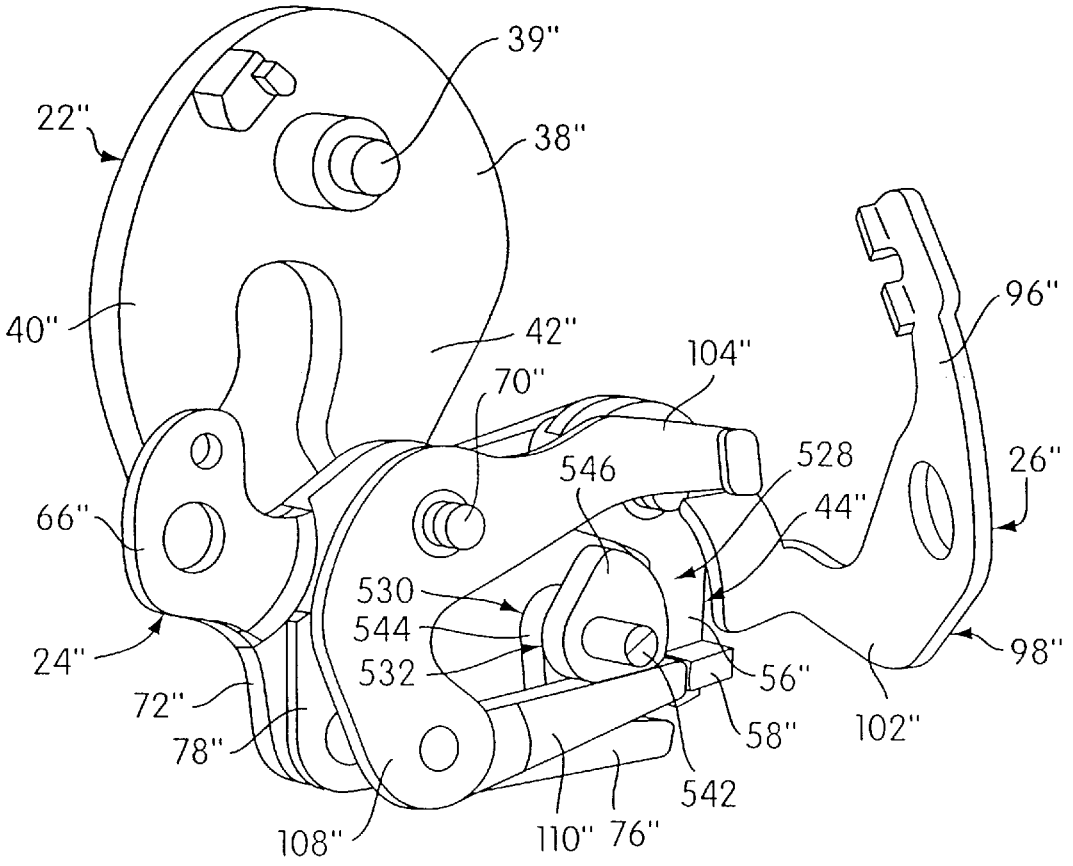
FIG. 27 is a perspective view similar to FIG. 10 showing another vehicle locking assembly embodying the principles of the present invention with the parts shown in a position with the outside locked and the inside unlocked.
Figure 28:
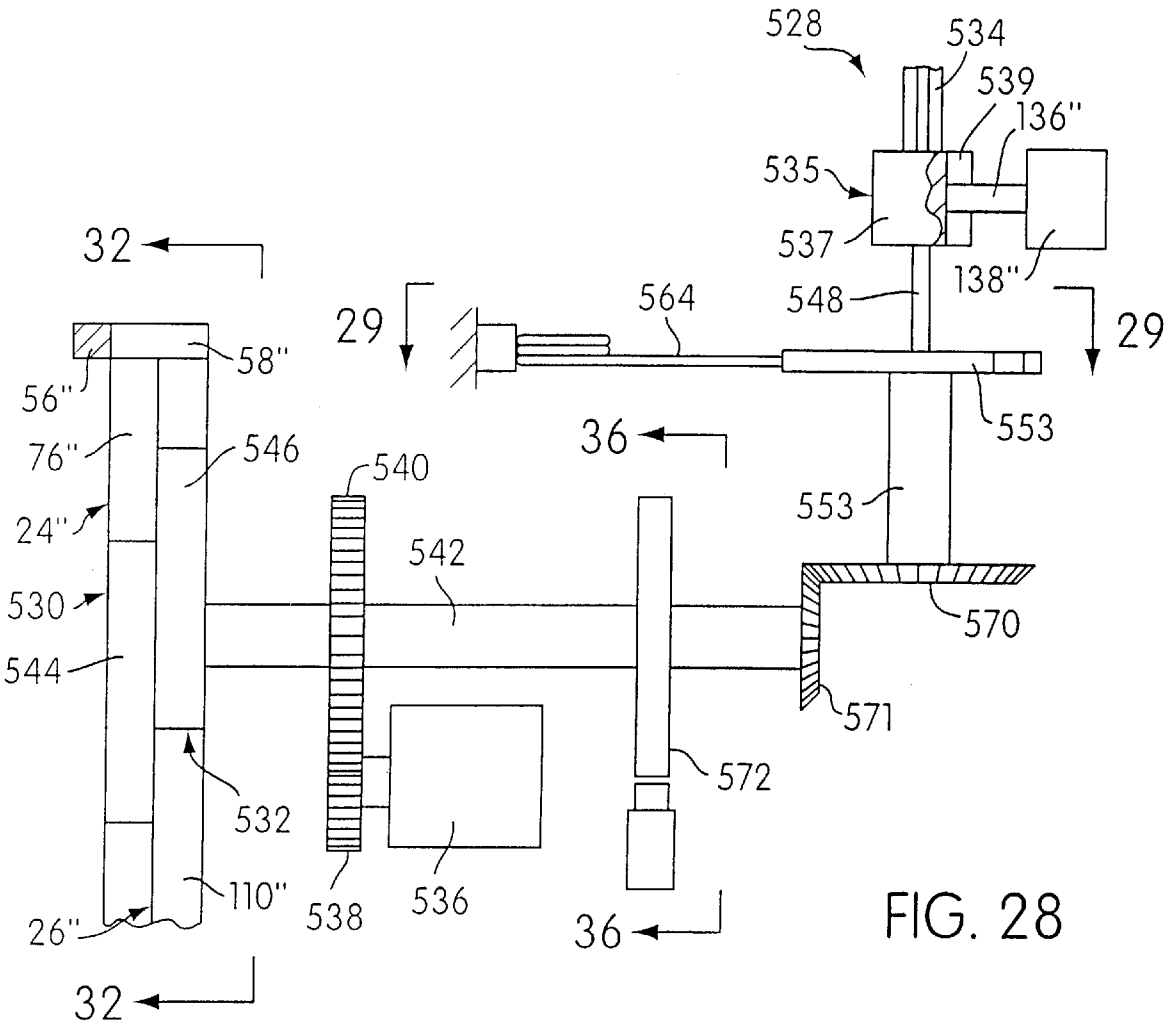
FIG. 28 is a top plan view of the components of the key actuated door locking and unlocking assembly of the vehicle door locking assembly shown in FIG. 27.

As best shown in FIG. 28, the single motor 536 has a spur gear 538 on the output shaft thereof which meshes with a larger spur gear 540 fixed to a shaft 542. As best shown in FIG. 27, the shaft 542 is mounted in the same position with respect to the door latching assembly 22" and outer and inner door latch releasing mechanisms 24" and 26" as the shaft 170.

The power operated outer locking mechanism 530 comprises an outer cam 544 fixed on the shaft 542. The power operated inner locking mechanism 532 comprises an inner cam 546. The outer and inner cams 544 and 546 are shown in abutting relation and may be formed as one piece. The term "separate" as it is used herein to describe the power operated outer and inner locking mechanisms 30 and 32, 330 and 332, or 530 and 532, is used in an operative sense rather than a physical sense. Physically, they constitute two separate entities but they need not be separated physically. The separate entities operate separately in that the outer locking mechanism 530 can be power operated separately into a locked position while the inner locking mechanism 532 is in an unlocked position and, in the case of the back doors, the outer locking mechanism 530 can be power operated separately into an unlocked position while the inner locking mechanism is in a locked position.

Figure 29:
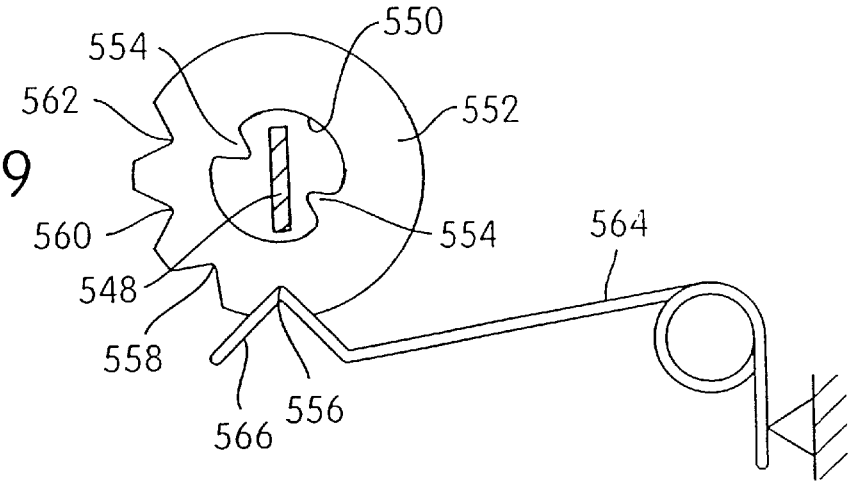
FIG. 29 is a sectional view taken along the line 29—29 of FIG. 28 showing the parts in an outside and inside unlocked position.
Figure 30:
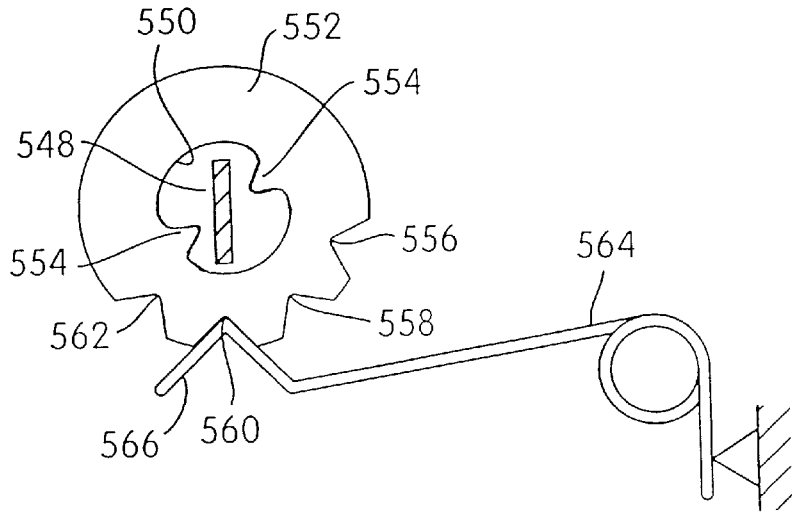
FIG. 30 is a view similar to FIG. 29 showing the parts in an outside and inside locked position.
Figure 31:
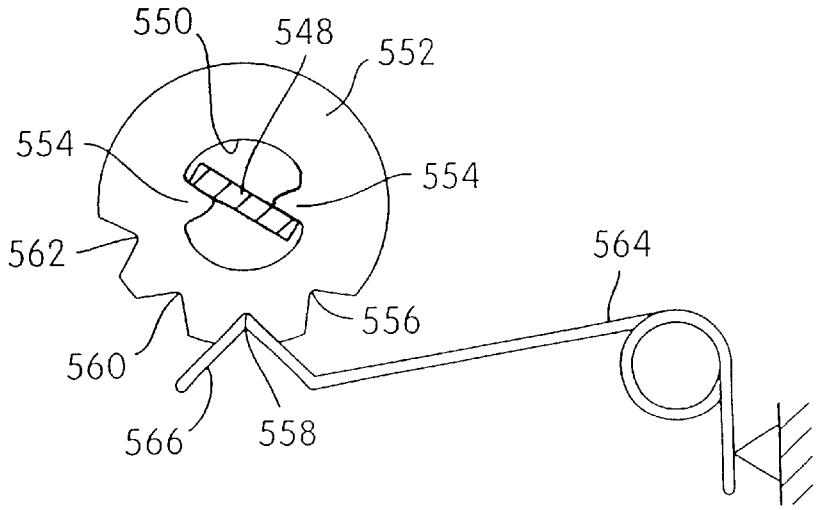
FIG. 31 is a view similar to FIG. 29 showing the parts in an outer locked and inner unlocked position into which they have been manually moved from the position shown in FIG. 29.

The annular member 537 which is turned by the key is connected to mechanically turn the shaft 542 in the following manner. The annular member 537 includes a blade like extension 548 which is fixed to turn with the annular member 537 and the key. As best shown in FIGS. 29–31, the blade 548 extends within a central opening 550 formed in an annular member 552 fixed to a shaft 553 suitably journalled to pivot or rotate about an axis perpendicular to the axis of the shaft 542. Extending radially inwardly within the opening 550 is a pair of diametrically opposed blade engaging lugs 554.

A portion of the periphery of the annular member 552 includes a series of four V-shaped notches therein indicated at 556, 558, 560 and 562. A spring 564 having a V-shaped free end 566 is mounted in cooperating relation with the annular member 552 so that the V-shaped end 566 of the spring 564 will enter and be biased out of successive notches as the annular member 552 is moved from the position shown in FIG. 29 in a counterclockwise direction. The spring 564 serves as an indexing means to define four different positions for the annular member 552 when the V-shaped end 566 is within the four different notches.

Fixed to the shaft 553 is a large bevel gear 570 disposed in meshing engagement with a bevel gear 571 fixed to the shaft 542. In this way, the four indexing positions of the annular member 552 are interrelated to four indexed positions of the shaft 542 which are displaced 90° apart. In order to relate the position of the shaft 542 with respect to the four indexing positions, a position senser 572 is fixed on the shaft 542.

The outer cam 544 is movable between locked and unlocked positions by the shaft 542. The unlocked position corresponds to the indexed positions of the shaft 542 when notches 556 and 562 are entered by the spring end 566. The locked position corresponds to the indexed positions of the shaft 542 when notches 558 and 560 are entered by the spring end 566. Similarly, the inner cam 546 is movable between locked and unlocked positions by the shaft 542. The unlocked position corresponds to the indexed positions of the shaft 542 when notches 556 and 558 are entered by the spring end 566. The locked position corresponds to the indexed positions of the shaft 542 when notches 560 and 562 are entered by the spring end 566.

Figure 33:
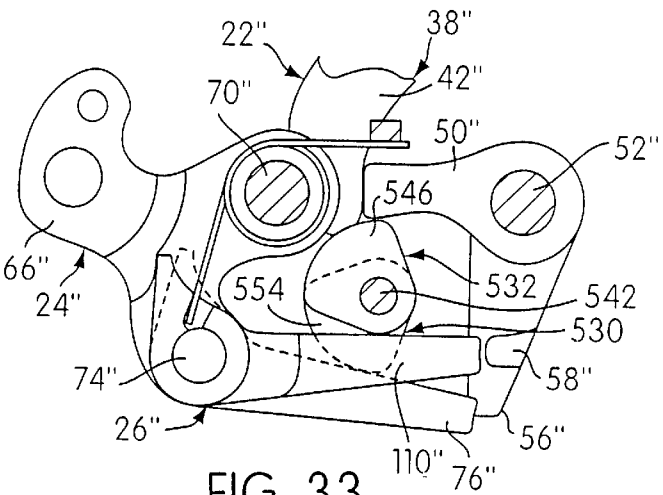
FIG. 33 is a view similar to FIG. 32 with the parts shown in an outside locked and inside unlocked position.
Figure 32:
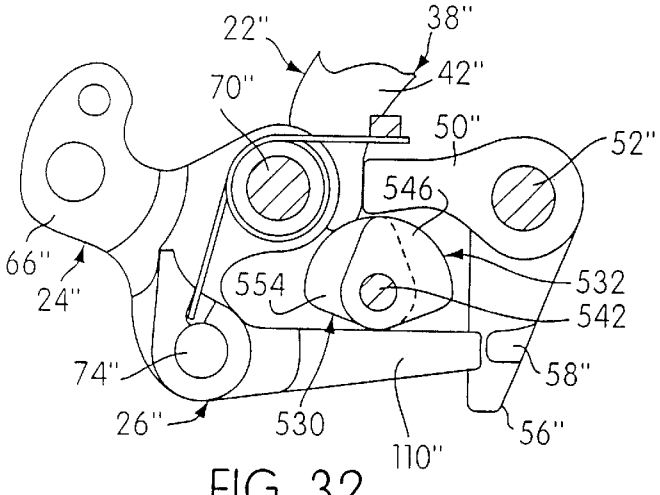
FIG. 32 is a sectional view taken along the line 32—32 of FIG. 28 with the parts shown in an outside and inside unlocked position.
Figure 35:
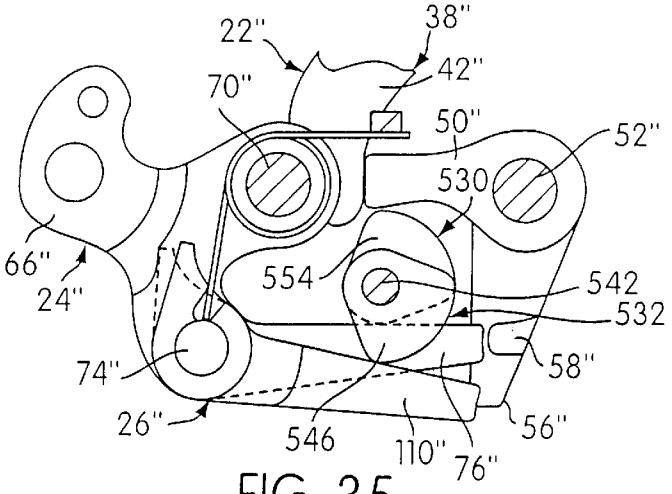
FIG. 35 is a view similar to FIG. 32 with the parts shown in an outside unlocked and inside locked position.
Figure 34:
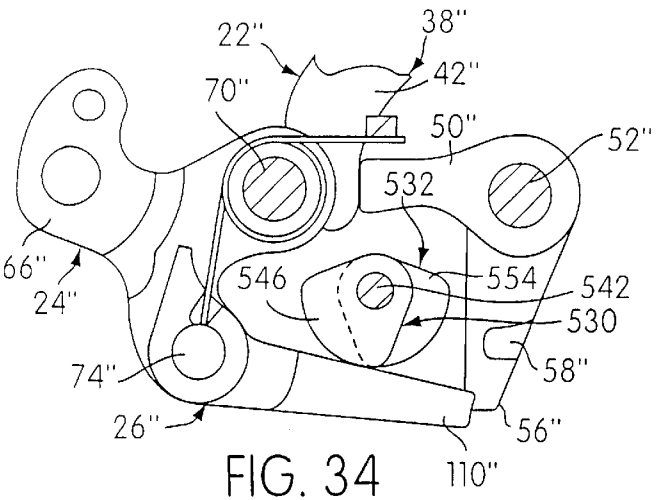
FIG. 34 is a view similar to FIG. 32 with the parts shown in an outside and inside unlocked position.

When the spring end 566 is disposed within the notch 556, the cam 544 of the outer door locking mechanism 530 is in an unlocked position and the cam 546 of the door locking mechanism 532 is also in an unlocked position which is illustrated in FIG. 32. As shown in FIG. 29, the blade 548 can have a few degrees of turning movement before engaging the lugs 554. During this movement, the switch arm 136" is moved to actuate the switch 138" which energizes the motor 536 to effect a counterclockwise movement of the shaft 542. After the shaft 542 has been moved 90°, the outer cam 544 has been moved from the unlocked position thereof into the locked position thereof while the inner cam 546 is retained in the unlocked position thereof. This position is illustrated in FIG. 33 and it corresponds with the position of the spring end 566 when entered within the notch 558. During the next 90° of movement of the shaft 542 in a counterclockwise direction, the outer cam 544 is retained in its locked position and the inner cam 546 is moved from the unlocked position thereof into the locked position thereof. This position is illustrated in FIG. 34 and it corresponds to the position of the spring end 566 within the notch 560, as shown in FIG. 30. During the next 90° of movement of the shaft 542 in a counterclockwise direction, the outer cam 544 is moved from the locked position thereof into the unlocked position thereof and the inner cam 546 is position is illustrated in FIG. 35 and corresponds with the position of the annular member 552 when the spring end 566 is disposed within the notch 562.

It will be noted that the position of the lugs 554 with respect to the blade 548 is such that all of the power movements of the annular member 552 can take place without the lugs 554 engaging the blade 548 while it is retained in the centered position shown in FIGS. 29 and 30. It will also be understood that a power movement in the opposite direction can be achieved simply by reversing the direction of movement of the motor 536. The cooperation of the outer door locking mechanism 530 and inner door locking mechanism 532 with respect to the door latching assembly 22", the outer latch releasing mechanism 24" and the inner door releasing mechanism 26" is the same as previously described since the cams 554 and 556 act in the same manner as the cams 172 and 194.

The manual operation of the inner and outer locking mechanisms 530 and 532 can best be understood with reference to FIGS. 29, 30 and 31. As can be seen from FIG. 29, if the blade 548 is turned in a counterclockwise direction, it will effect a corresponding movement of the annular member 552 once the lost motion necessary for actuation of the switch 138" has been taken up. Movement of the annular member 552 is allowed to take place when the motor 536 is without power since the motor 536 will free-wheel and so will the spur gear set 538 and 540, thus allowing the shaft 542 to be turned. After the annular member 552 has been moved a sufficient number of degrees to allow the spring end 566 to enter the notch 558, the cams 544 and 546 will be moved into the position shown in FIG. 33, so that the outside of the door is locked by the outer door locking mechanism 530 and the inside of the door is unlocked. The member 548 can be provided with a stop which would prevent further manual movement beyond this position if desired or it can be enabled to move further so as to further move the annular member 552 into a position where the spring end 566 enters the notch 560 in which case both the inside and outside of the door will be locked, as shown in FIG. 34. It will be understood that further movement of the blade 548 in a counterclockwise direction could be provided for moving the annular member 552 in a position where the spring 566 is engaged within the notch 562. However, it would be desirable to provide a stop for the movement of the blade 548 which would prevent this movement. It will also be understood that, if the door is locked on the inside and outside a condition which is illustrated in FIG. 30, a clockwise movement of the blade 558 will serve to effect a movement of the member 552 from the position shown in FIG. 30 into the position shown in FIG. 29.

Figure 36:
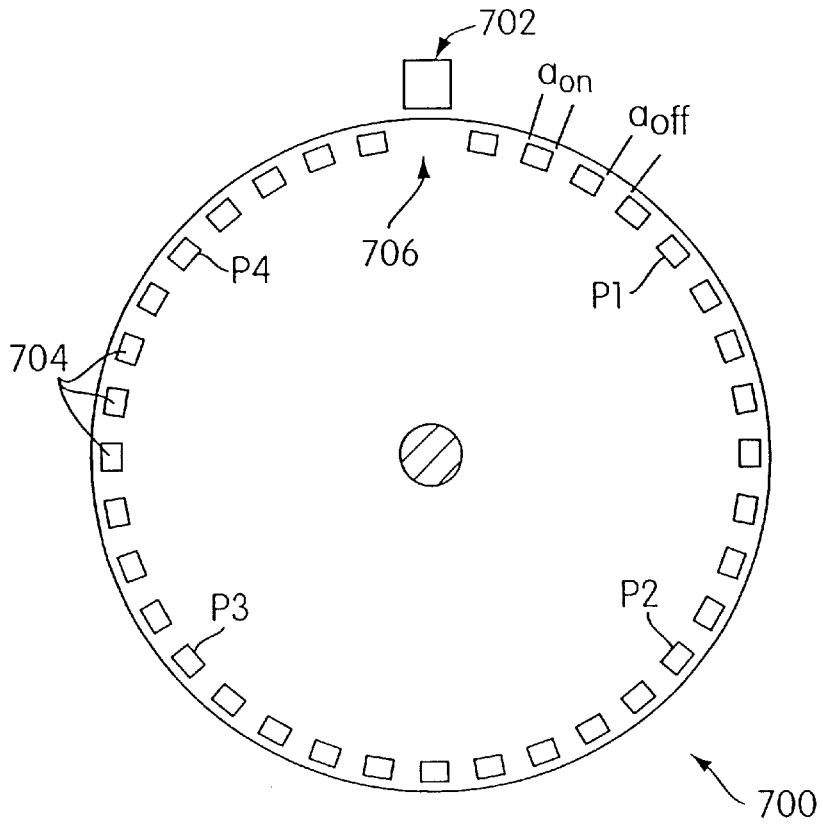
FIG. 36 is an enlarged fragmentary sectional view taken along the line 36—36 of FIG. 28.

As illustrated in FIG. 36, the position sensor 572 of the embodiment illustrated in FIG. 27 includes a plurality of trigger elements mounted for rotation with the shaft 542 and a stationary electronic element which detects passage of each trigger element. Preferably, a magnet-carrying disk 700 (or alternatively, a drum) is fixedly mounted to the shaft 542 for rotation therewith. A stationary magnetic field sensor 702 serves as the stationary electronic element and emits an electrical pulse each time one of the magnets on the magnet-carrying disk 700 passes by the sensor 702.

The disk 700 preferably includes about thirty-five individual magnets (or magnetic elements) 704 which serve as the trigger elements and which are evenly spaced about the circumference of the disk 700 except at a reference spot 706 on the disk 700. A larger separation between magnets 704 is provided at the reference spot 706.

Figure 38:
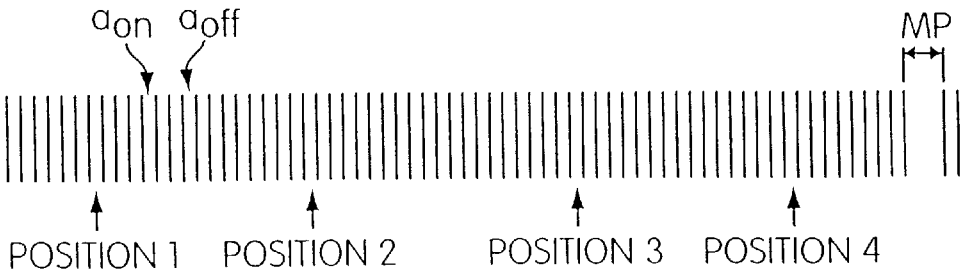
FIG. 38 is a graph of the pulse train transmitted by the sensor shown in FIG. 36.

When the disk 700 rotates, the sensor 702 responds to the passing of each magnet 704 by emitting an electrical pulse. An exemplary pulse train is graphically illustrated by way of example in FIG. 38. When the reference spot 706 passes by the sensor 702, a temporal gap (missing pulse MP) appears in the train of pulses being emitted by the sensor 702. This temporal gap thus provides a way of detecting when the disk is rotationally oriented such that the reference spot 706 is immediately adjacent to the sensor 702.

In FIG. 36, the positions P1, P2, P3 and P4, which correspond to the positions of the cams 544 and 546 shown in FIGS. 32–35 respectively, are aligned with the sensor 702 when the first, second, third, and fourth orientations, respectively, of the shaft 542 are achieved according to the embodiment of FIG. 27. Thus, the positions P1, P2, P3 and P4 are aligned with the sensor 702 when the first, second, third and fourth locking and unlocking operations of the FIG. 27 embodiment are achieved. Preferably, the reference spot 702 lies between two such positions.

Figure 37:
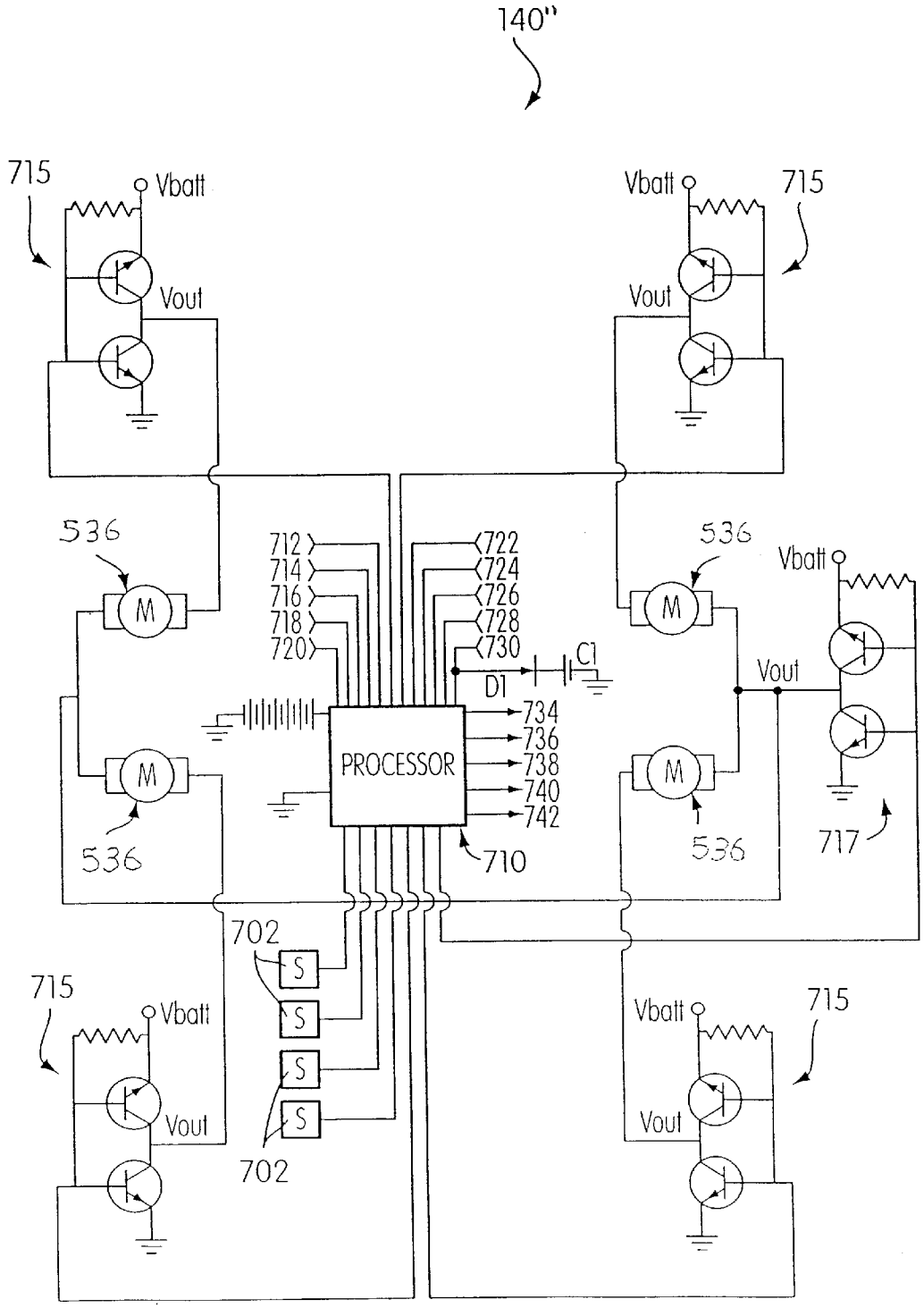
FIG. 37 is an enlarged schematic view similar to FIG. 16 relating to the vehicle door locking assembly shown in FIGS. 27–36.

As illustrated in FIG. 37, the circuitry, generally indicated at 140", is provided for controlling the energization and deenergization of the motor 536.

The circuitry 140" preferably includes a processor 710; four motors 536; four drive circuits 715; a common drive circuit 717; and four position sensors 572 of the type illustrated in FIG. 36. The signals 712–742 at the processor 710 correspond respectively to the signals 212–242 which were described in connection with the circuitry 140.

Each motor 536 is mechanically connected so as to rotatably drive a respective one of the shafts 542 which carry the cams 544 and 546. Electrically, each motor 536 has one of its power terminals connected to a respective one of the drive circuits 715. The other power terminal of each motor 536 is electrically connected to an output from the common drive circuit 717. By selectively applying logic signals (i.e., logic 1, or logic 0) to each drive circuit 715 and to the common drive circuit 717, the processor 710 can selectively activate each motor 536 and reverse its direction of a rotation.

For example, one or more of the motors 536 can be rotated in a first rotational direction by applying a "logic 1" signal to its (or their) respective drive circuit(s) 715 and a "logic 0" signal to the common drive circuit 717. The "logic 1" signal at the drive circuit(s) 715 causes the battery voltage Vbatt to appear as the output voltage Vout of such drive circuit(s) 715, while the output of the common drive circuit 717 remains grounded. Electrical current therefore flows through the windings of the activated motors 536 to provide a desired rotation in a first direction.

Rotation of the activated motor(s) 536 can be stopped by applying the same logic signal to their respective drive circuit(s) 715 as is being applied to the common drive circuit 717. Since there is no potential differences across the power terminals of the previously activated motor(s) 536, the motor(s) are effectively deactivated.

If reversal of motor rotation is desired, the processor merely applies a "logic 1" signal to the common drive circuit 717 and a "logic 0" signal to the drive circuit(s) 715 of any motor(s) 536 which is (are) to be rotated in the reverse direction. Since this reverses the direction of current flow through the windings of such motors 536, the motors 536 rotate in a reverse direction.

The motors 536 which are not to rotate are again kept stationary by applying a logic signal to their respective drive circuits 715 which is equal to the logic signal being applied to the common drive circuit 717.

The amount of rotation imparted to each motor 536 is monitored by the processor 710 via the pulse trains received from the sensors 702 associated with each vehicle door.

Depending on the inputs received from the signals 712–730, the processor 710 determines which of the four rotational orientations is desired for each of the shafts 542. The processor 710 then applies appropriate logic signals to the drive circuits 715 and the common drive circuit 717, and monitors the pulse trains from the respective position sensors 572. When such monitoring indicates that the desired orientation has been achieved in any of the motors 536, the processor 710 deactivates that (those) motor(s) 536 and continues to monitor and deactivate other motors until all of the motors 536 which were activated have achieved the desired shaft orientations.

This application of logic signals is controlled in the processor 710 by an appropriate program. The program can be provided using known programming techniques, and variations in such programming can be made depending on the operation desired at each of the doors' locking arrangements. The programming, for example, could preclude the shafts 542 in the front doors of the vehicle from achieving the orientation associated with the "child lock" operation described above. Other combinations of locking arrangements can be provided or precluded in response to the signals 712–730. Examples of such combination have been described in connection with the embodiment illustrated in FIG. 16; however, it is understood that numerous other combinations can be achieved depending on the particular locking and unlocking responses desired at the different doors of the vehicle under varying circumstances and in response to different user inputs.

Figure 39:
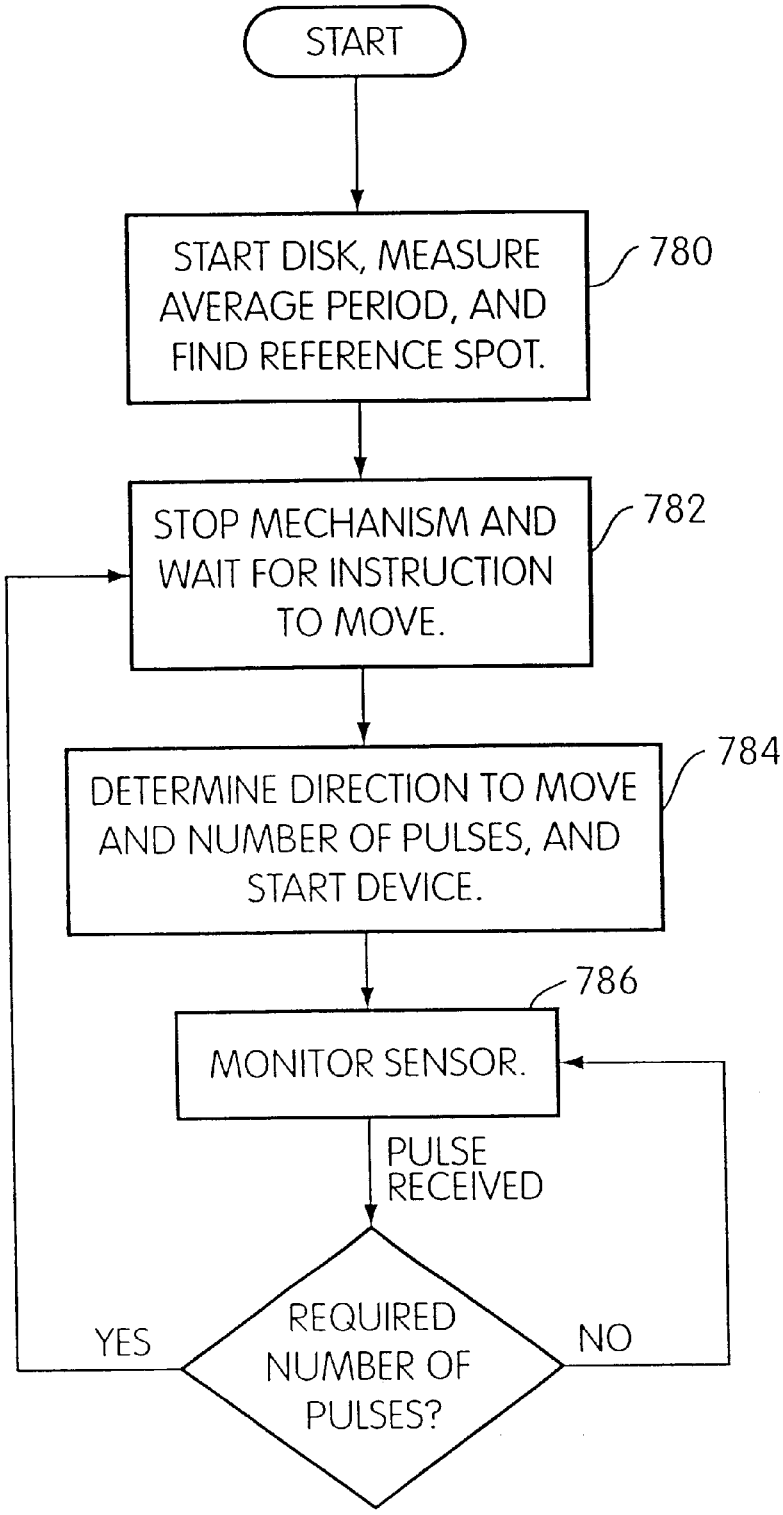
FIG. 39 is a flow chart of a program carried out by the processor shown in FIG. 37.

FIG. 39 is a flow chart illustrating a preferred program carried out by the processor 710 in determining the rotational orientation of a single shaft 542.

Upon initialization of the processor 710 (step 780), the motor 536 is actuated in a predetermined direction while the pulse train is monitored by the processor 710. The cycle time (tc) of a nominal trigger is approximated by averaging the timing of all received pulses. After the average stabilizes, the processor monitors the pulse train for a specific deviation from the average, which deviation is indicative of the presence of the reference spot 706 at the sensor 702.

Alternatively, if the mechanical assembly must be rotated at varying rates, compensation for such varying rates can be provided by monitoring the supply voltage of the motor 536 and detecting passage of the reference spot 706 accordingly.

Once the presence of the reference spot 706 has been detected by the processor 710, the processor 710 achieves a predetermined initial orientation of the shaft 542 by appropriately activating the corresponding motor 536 as described above.

Upon achieving the predetermined orientation of the shaft 542, the processor 710 monitors (step 782) the signals 712–730 for user inputs. If a user input represented by one of the signals 712–730 indicates that at least one of the locking or unlocking operations described in connection with the embodiment of FIG. 26 is desired, the processor 710 activates the appropriate motor(s) 536, as described above, by applying the appropriate combination of logic signals to the drive circuits 715 and the common drive circuit 717.

Preferably, the program which controls operation of the processor 710 includes program modules which determine which direction of rotation is more desirable during rotation of the shaft 542 from the present orientation to the orientation which achieves the desired one of the four aforementioned locking or unlocking operations. This direction of rotation is determined during programming of the processor 710 and preferably after considering several factors. Such factors may include, for example, the desirability of minimizing the travel delay from one orientation to the next, and/or the desirability of avoiding transitions through an orientation which achieves a particular one of the four locking or unlocking operations.

Upon determining which direction of rotation is desired (step 784), the processor 710 activates the appropriate motor(s) 536 to effect rotation of the corresponding shaft(s) 542.

The processor 710 is programmed to detect (step 786) a predetermined number of pulses before deactivating the activated motor(s) 536, which number of pulses corresponds to the number of trigger elements (or magnets 704) located between the start position and the destination position of the disk 700. Upon receiving the appropriate number of pulses, the processor 710 stops (782) rotation of the motor 536 and awaits further user inputs.

If, for example, the processor 710 determines based on the signals 712–730 that one of the shafts 542 is to be rotated from an orientation wherein the reference spot 706 is located at the sensor 702 to an orientation wherein position P2 of the disk 700 is adjacent to the sensor 702, then clockwise rotation of shaft 542 would continue under the processor's control until thirteen pulses are detected, at which time the motor 536 associated with that particular shaft 542 is deactivated by the processor 710.

Preferably, the processor 710 stores, in an appropriate memory element, a value indicative of the present orientation of the shaft 542 before, during, or after deactivation of the motor 536. This memory element may be included in the processor 710 or may be provided by virtue of a separate memory unit (not shown). The memory element preferably is updated upon each rotation of the shaft 542 so that the processor 710 always has access to the starting position of the shaft 542 before any further rotations.

For additional confirmation of position, additional deviations in trigger separation can be provided for detection by the processor 710. Based on detected variations in the pulse train caused by such deviations, the processor 710 achieves verification of the detected position of the disk 700. In the event such verification indicates that a discrepancy exists, the processor may be programmed to rerun the reference spot finding sequence. The additional deviations in trigger separation can be located anywhere around the circumference of the disk 700.

Although the preferred embodiment illustrated in FIGS. 34 and 35 includes four sets of motors and position sensors for a four-door vehicle arrangement, it is understood that the present invention is not limited to such an arrangement. To the contrary, two motors and two position sensors can be provided, for example, in a two-door vehicle. Generally, one motor and one position sensor are provided for each door which is to be locked and unlocked in accordance with the operations provided by this embodiment.

Furthermore, it is understood that various other known position sensing arrangements can be used in place of the position sensor 572 without deviating from the spirit and scope of the present invention. Examples of such arrangements include optical position sensors, metal wipers with separate electrified pads which electrically contact the metal wipers to provide the desired pulses, and the like. The position sensor 542 also can be realized using linear components, as opposed to rotary components. A linear component advantageously provides limits to the rotation of the shaft 542. Similar rotational limits can be realized in a rotary arrangement by providing stops on the trigger-carrying member (e.g. the disk 700).

The illustrated positioning arrangement is preferred because it strikes a desirable balance between such factors as response speed, accuracy of positioning, component minimization, costs, applicability, and reliability. A primary advantage of the illustrated arrangement is the ability to use a single sensor which, in turn, translates into cost reductions and savings in the amount of space required by the illustrated arrangement. Additional benefits can be achieved by appropriately selecting components and software in the processor 710, to achieve direction feedback and velocity reduction for accurate positioning.

The interconnection between each motor 536 and the respective shaft 542 preferably is provided using gear reduction. The amount of gear reduction is selected to achieve a desired amount of torque and speed, and also to minimize overrun of various positions by the shaft 542. The tolerances of positioning will be largely determined by factors such as the rate of rotation of the shaft 542 and the time (td) elapsed after deactivating the motor 536 before the shaft 542 comes to rest. Dynamic braking of the electric motors 536 or similar techniques can be employed to improve positional accuracy.

The processor 710 preferably is selected so that its electronic response time is orders of magnitude smaller than the mechanical delays and hence negligible for most applications.

The present invention also is not limited to the number and arrangement of trigger elements shown in FIG. 34. To the contrary, many different arrangements are possible, and the number of trigger elements can be changed to achieve different resolutions and levels of accuracy. These differences in resolution and accuracy result from the fact that a larger number of trigger elements allows smaller angles of rotation to generate a pulse, and thereby permits detection of such smaller angles of rotation.

The exemplary angle (in radians) circumscribed by the active state of a nominal sensor trigger is shown in FIG. 34 as aon and that of the inactive state is shown as aoff. Where the rate of rotation of the disk 700 is w, the on and off times (ton and toff) of the pulse train generated by the sensor 702 will be:

$$t\text{on}=a\text{on}/w,$$

and $$t\text{off}=a\text{off}/w.$$

By decreasing aon, the positional accuracy is increased since the disk 700 may be travelling in either direction, signaling the processor 710 at two different locations respectively. Preferably, ton would be chosen as 2td, minimizing positional difference in these two locations. If the delay time is too great to stop within a reasonable pulse duration, the processor 710 can be programmed to slow the shaft upon approaching the destination pulse, thereby improving stopping tolerances.

The value of aoff can be chosen to provide a sufficient number of triggers per revolution to allow for the identification of the deviations(s) in the pulse train as described above.

The rise and fall times of typical electronic sensors is on the order of 10–100 nanoseconds (ns) and a microcontroller which can be used as processor 710 can be expected to monitor and analyze such a signal with a period of about 10–100 mseconds. To switch an electromechanical driver such as a relay and for the mechanical device to run to operating levels may take on the order of 10–100 ms. Starting and stopping times also are strongly influenced by the mass and inertia of the mechanical system. These factors all can be compensated for using appropriate programming of the processor 710 to achieve a sufficient accurate actuation of the shaft into any one of the four exemplary positions described above.

It thus will be seen that the objects of this invention have been fully and effectively accomplished. It will be realized, however, that the foregoing preferred specific embodiment has been shown and described for the purpose of this invention and is subject to change without departure from such principles. Therefore, this invention includes all modifications encompassed within the spirit and scope of the following claims.

What is claimed is:

1. A power-operated vehicle door locking assembly for a vehicle door movable between open and closed positions with respect to a vehicle body opening, the vehicle door having inner and outer manually movable actuating members, said power-operated vehicle door locking assembly comprising:

a housing assembly constructed and arranged to be mounted in the vehicle door, a door latching assembly carried by said housing assembly constructed and arranged to be moved (1) into a door latching position in response to the engagement of a striker in the vehicle body opening therewith occasioned by a movement of the vehicle door into the closed position thereof so as to latch the door in a closed position within the vehicle body opening and (2) from the door latching position thereof into a door unlatching position to allow the door to be moved into the open position thereof, an outer door latch releasing mechanism constructed and arranged with respect to said housing assembly to be moved (1) from an inoperative position into a latch releasing position in response to the manual movement of the outer actuating member from an inoperative position into a door releasing position and (2) from the latch releasing position thereof into the inoperative position thereof, said outer door latch releasing mechanism being constructed and, arranged with respect to said door latching assembly so that when the vehicle door is in its closed position movement of said outer door latch releasing mechanism from the inoperative position thereof to the latch releasing position thereof moves said door latching assembly from the door latching position thereof to the door unlatching position thereof to allow the door to be moved into its open position, an inner door latch releasing mechanism constructed and arranged with respect to said housing assembly to be moved (1) from an inoperative position into a latch releasing position in response to the manual movement of the inner actuating member from an inoperative position into a door releasing position and (2) from the latch releasing position thereof into the inoperative position thereof, said inner door latch releasing mechanism being constructed and arranged with respect to said door latching assembly so that when the vehicle door is in its closed position movement of said inner door latch releasing mechanism from the inoperative position thereof to the latch releasing position thereof moves said door latching assembly from the door latching position thereof to the door unlatching position thereof to allow the door to be moved into its open position, separate inner and outer door locking mechanisms connected with said housing assembly, said outer door locking mechanism being constructed and arranged with respect to said housing assembly to be moved between inoperative and outer door locking positions, said outer door locking mechanism being constructed and arranged with respect to said outer door latch releasing mechanism to disable said outer door latch releasing mechanism from moving from the inoperative position thereof into the latch releasing position thereof when said outer door locking mechanism is in the outer door locking position thereof, said inner door locking mechanism being constructed and arranged with respect to said housing assembly to be moved between inoperative and inner door locking positions, said inner door locking mechanism being constructed and arranged with respect to said inner door latch releasing mechanism to disable said inner door latch releasing mechanism from moving from the inoperative position thereof into the latch releasing position thereof when said inner door locking mechanism is in the door locking position thereof, and an electrically operable system constructed and arranged to convert a source of electricity on the vehicle into mechanical motion in response to manual electrical energizing actuations, said electrically operable system being constructed and arranged with respect to said inner and outer door locking mechanisms to selectively move (1) said inner door locking mechanism between the inoperative and inner door locking position thereof in response to inner manual electrical energizing actuations and (2) said outer door locking mechanism between the inoperative and outer door locking positions thereof in response to outer manual electrical energizing actuations, the arrangement being such that an outer manual electrical energizing actuation without a corresponding inner manual electrical energizing actuation causes said door latching assembly when in the door latching position thereof to be incapable of being moved into the door unlatching position thereof by said outer door latch releasing mechanism while at the same time said door latching assembly is capable of being moved into the door unlatching position thereof by said inner door latch releasing mechanism, said power-operated vehicle door locking assembly further including a key actuated door locking and unlocking assembly constructed and arranged with respect to said housing assembly to be moved between a locked mode and an unlocked mode in response to the manual movement of a key therein, said key actuated door locking and unlocking assembly being constructed and arranged with respect to said electrically operable system to provide outer electrical energizing actuations for said electrically operable system when moved away from the locked and unlocked modes thereof by manual movements of a key therein, wherein said key actuated door locking and unlocking assembly is constructed and arranged to be manually moved when in said locked mode from a key entering and exiting position in one turning direction into an unlocked position in said unlocked mode and when in said unlocked mode from the key entering and exiting position in an opposite turning direction into a locked position in said locked mode, said outer and inner manual electrical energizing actuations including electric signals generated in response to the manual movement of said key actuated door locking and unlocking assembly out of the key entering and exiting position in either of said turning directions, wherein said key actuated door locking and unlocking assembly is constructed and arranged with respect to said outer and inner door locking mechanisms to effect a mechanical movement thereof in the event of a failure of the electricity source from the locked position thereof to the unlocked position thereof in response to the turning movement of said key actuated door locking and unlocking assembly when in said locked mode in said one direction from the key entering and exiting position thereof into the unlocked position thereof, and wherein said door latching assembly includes a holding and releasing lever movable between holding and releasing positions, said outer door latch releasing mechanism including an outer releasing arm movable from an inoperative position into a releasing position to move said holding and releasing lever from the holding position thereof into the releasing, position thereof, said inner door latch releasing mechanism including an inner releasing arm movable from an inoperative position into a releasing position to move said holding and releasing lever from the holding position thereof into the releasing position thereof.

2. A power-operated vehicle door locking assembly as defined in claim 1, wherein said outer door locking mechanism includes an outer cam movable between unlocked and locked positions, said outer cam being constructed and arranged with respect to said outer releasing arm to (1) allow the outer releasing arm to be moved from the inoperative position thereof into the releasing position thereof when said outer cam is in the unlocked position thereof and (2) to move the outer releasing arm from the inoperative position thereof into a disabled position from which said outer releasing arm cannot move into the releasing position thereof, said inner door locking mechanism including an inner cam movable between unlocked and locked positions, said inner cam being constructed and arranged with respect to said inner releasing arm to (1) allow the inner releasing arm to be moved from the inoperative position thereof into the releasing position thereof when said inner cam is in the unlocked position thereof and (2) to move the inner releasing arm from the inoperative position thereof into a disabled position from which said inner releasing arm cannot move into the releasing position thereof.

3. A power-operated vehicle door locking assembly for a vehicle door movable between open and closed positions with respect to a vehicle body opening, the vehicle door having inner and outer manually movable actuating members, said power-operated vehicle door locking assembly comprising:

a housing assembly constructed and arranged to be mounted in the vehicle door, a door latching assembly carried by said housing assembly constructed and arranged to be moved (1) into a door latching position in response to the engagement of a striker in the vehicle body opening therewith occasioned by a movement of the vehicle door into the closed position thereof so as to latch the door in a closed position within the vehicle body opening and (2) from the door latching position thereof into a door unlatching position to allow the door to be moved into the open position thereof, an outer door latch releasing mechanism constructed and arranged with respect to said housing assembly to be moved (1) from an inoperative position into a latch releasing position in response to the manual movement of the outer actuating member from an inoperative position into a door releasing position and (2) from the latch releasing position thereof into the inoperative position thereof, said outer door latch releasing mechanism being constructed and, arranged with respect to said door latching assembly so that when the vehicle door is in its closed position movement of said outer door latch releasing mechanism from the inoperative position thereof to the latch releasing position thereof moves said door latching assembly from the door latching position thereof to the door unlatching position thereof to allow the door to be moved into its open position, an inner door latch releasing mechanism, constructed and arranged with respect to said housing assembly to be moved (1) from an inoperative position into a latch releasing position in response to the manual movement of the inner actuating member from an inoperative position into a door releasing position and (2) from the latch releasing position thereof into the inoperative position thereof, said inner door latch releasing mechanism being constructed and arranged with respect to said door latching assembly so that when the vehicle door is in its closed position movement of said inner door latch releasing mechanism from the inoperative position thereof to the latch releasing position thereof moves said door latching assembly from the door latching position thereof to the door unlatching position thereof to allow the door to be moved into its open position, and separate inner and outer door locking mechanisms connected with said housing assembly, said outer door locking mechanism being constructed and arranged with respect to said housing assembly to be moved between inoperative and outer door locking positions, said outer door locking mechanism being constructed and arranged with respect to said outer door latch releasing mechanism to disable said outer door latch releasing mechanism from moving from the inoperative position thereof into the latch releasing position thereof when said outer door locking mechanism is in the outer door locking position thereof, said inner door locking mechanism being constructed and arranged with respect to said housing assembly to be moved between inoperative and inner door locking positions, said inner door locking mechanism being constructed and arranged with respect to said inner door latch releasing mechanism to disable said inner door latch releasing mechanism from moving from the inoperative position thereof into the latch releasing position thereof when said inner door locking mechanism is in the door locking position thereof, an electrically operable system constructed and arranged to convert a source of electricity on the vehicle into mechanical motion in response to manual electrical energizing actuations, said electrically operable system being constructed and arranged with respect to said inner and outer door locking mechanisms to selectively move (1) said inner door locking mechanism between the inoperative and inner door locking position thereof in response to inner manual electrical energizing actuations and (2) said outer door locking mechanism between the inoperative and outer door locking positions thereof in response to outer manual electrical energizing actuations, the arrangement being such that an outer manual electrical energizing actuation without a corresponding inner manual electrical energizing actuation causes said door latching assembly when in the door latching position thereof to be incapable of being moved into the door unlatching position thereof by said outer door latch releasing mechanism while at the same time said door latching assembly is capable of being moved into the door unlatching position thereof by said inner door latch releasing mechanism, wherein said door latching assembly includes a holding and releasing lever movable between holding and releasing positions, said outer door latch releasing mechanism including an outer releasing arm movable from an inoperative position into a releasing position to move said holding and releasing lever from the holding position thereof into the releasing position thereof, said inner door latch releasing mechanism including an inner releasing arm movable from an inoperative position into a releasing position to move said holding, and releasing lever from the holding position thereof into the releasing position thereof.

4. A power-operated vehicle door locking assembly as defined in claim 3, wherein said outer door locking mechanism includes an outer cam movable between unlocked and locked positions, said outer cam being constructed and arranged with respect to said outer releasing arm to (1) allow the outer releasing arm to be moved from the inoperative position thereof into the releasing position thereof when said outer cam is in the unlocked position thereof and (2) to move the outer releasing arm from the inoperative position thereof into a disabled position from which said outer releasing arm cannot move into the releasing position thereof, said inner door locking mechanism including an inner cam movable between unlocked and locked positions, said inner cam being constructed and arranged with respect to said inner releasing arm to (1) allow the inner releasing arm to be moved from the inoperative position thereof into the releasing position thereof when said inner cam is in the unlocked position thereof and (2) to move the inner releasing arm from the inoperative position thereof into a disabled position from which said inner releasing arm cannot move into the releasing position thereof.

5. A power-operated vehicle door locking assembly as defined in claim 4, wherein said electrically operable system includes (1) an outer reversible electric motor constructed and arranged with respect to said outer door locking mechanism to move the same between the inoperative and outer door locking positions thereof and (2) an inner reversible electric motor constructed and arranged with respect to said inner door locking mechanism to move the same between the inoperative and door locking positions thereof.

6. A power-operated vehicle door locking assembly as defined in claim 5, wherein said outer door locking mechanism includes a first shaft on which said outer cam is fixed, an outer motion transmitting member constructed and arranged with respect to said housing assembly to be moved between unlocked and locked positions, an outer speed reduction gear train operatively connected between said outer electric motor and said outer motion transmitting member and an outer arm fixed to said first shaft and operatively connected to said outer motion transmitting member, said door locking mechanism includes a second shaft on which said inner cam is fixed, an inner motion transmitting member constructed and arranged with respect to said housing assembly to be moved between unlocked and locked positions, an inner speed reduction gear train operatively connected between said inner electric motor and said inner motion transmitting member, and an inner arm fixed to said second shaft and operatively connected to said inner motion transmitting member.

7. A power-operated vehicle door locking assembly as defined in claim 6, wherein said outer and inner speed reduction gear trains include outer and inner worm gears fixed to output shafts of said outer and inner electric motors respectively and outer and inner sector gears meshing with said outer and inner worm gears, the arrangement being such that motion imparted to said sector gears will move said worm gears and motors when said motors are without a source of electricity, said outer and inner motion transmitting members being pivoted to said outer and inner sector gears respectively.

8. A power-operated vehicle door locking assembly as defined in claim 6, wherein said outer and inner speed reduction gear trains include outer and inner relatively small outer and inner spur gears fixed to output shafts of said outer and inner electric motors, relatively large outer and inner spur gears meshing with said outer and inner small spur gears respectively, outer and inner pinions fixed to turn said outer and inner relatively large spur gears respectively and outer and inner rack teeth on said outer and inner motion transmitting members respectively, said outer and inner pinions meshing with said outer and inner rack teeth respectively.

9. A power-operated vehicle door locking assembly as defined in claim 4, wherein said electrically operable system includes a single motor constructed and arranged to move said outer and inner door locking mechanisms between the unlocked and locked positions thereof, said single motor being operatively connected through a speed reduction gear train to drive a shaft on which said inner and outer cams are fixed through four indexed positions including (1) an indexed position where said outer and inner cams are both in unlocked positions, (2) an indexed position where said outer cam is in a locked position and said inner cam is in an unlocked position, (3) an indexed position in which said outer and inner cams are both in locked positions, and (4) an indexed position in which said outer cam is in an unlocked position and said inner cam is in a locked position.

10. A power-operated vehicle door locking system for a vehicle having a plurality of vehicle doors movable between open and closed positions with respect to a corresponding plurality of vehicle body openings, said power-operated vehicle door locking system comprising:

a plurality of power-operated vehicle door locking assemblies operatively associated with said plurality of vehicle doors, each one of said plurality of power-operated vehicle door locking assemblies being carried by one of said plurality of vehicle doors and comprising a housing assembly constructed and arranged to be mounted in the vehicle door, a door latching assembly carried by said housing assembly constructed and arranged to be moved (1) into a door latching position in response to the engagement of a striker in the vehicle body opening therewith occasioned by a movement of the vehicle door into the closed position thereof so as to latch the door in a closed position within the vehicle body opening and (2) from the door latching position thereof into a door unlatching position to allow the door to be moved into the open position thereof, an outer door latch releasing mechanism constructed and arranged with respect to said housing assembly to be moved (1) from an inoperative position into a latch releasing position in response to the manual movement of the outer actuating member from an inoperative position into a door releasing position and (2) from the latch releasing position thereof into the inoperative position thereof, said outer door latch releasing mechanism being constructed and arranged with respect to said door latching assembly so that when the vehicle door is in its closed position movement of said outer door latch releasing mechanism from the inoperative position thereof to the latch releasing position thereof moves said door latching assembly from the door latching position thereof to the door unlatching position thereof to allow the door to be moved into its open position, an inner door latch releasing mechanism with respect to said housing assembly constructed and arranged to be moved (1) from an inoperative position into a latch releasing position in response to the manual movement of the inner actuating member from an inoperative position into a door releasing position and (2) from the latch releasing position thereof into the inoperative position thereof, said inner door latch releasing mechanism being constructed and arranged with respect to said door latching assembly so that when the vehicle door is in its closed position movement of said inner door latch releasing mechanism from the inoperative position thereof to the latch releasing position thereof moves said door latching assembly from the door latching position thereof to the door unlatching position thereof to allow the door to be moved into its open position, separate inner and outer door locking mechanisms connected with said housing assembly, said outer door locking mechanism being constructed and arranged with respect to said housing assembly to be moved between inoperative and outer door locking positions, said outer door locking mechanism being constructed and arranged with respect to said outer door latch releasing mechanism to disable said outer door latch releasing mechanism from moving from the inoperative position thereof into the latch releasing position thereof when said outer door locking mechanism is in the door locking position thereof, said inner door locking mechanism being constructed and arranged with respect to said housing assembly to be moved between inoperative and inner door locking positions, said inner door locking mechanism being constructed and arranged with respect to said inner door latch releasing mechanism to disable said inner door latch releasing mechanism from moving from the inoperative position thereof into the latch releasing position thereof when said inner door locking mechanism is in the door locking position thereof, and an electrically operable system constructed and arranged to convert a source of electricity on the vehicle into mechanical motion in response to manual electrical energizing actuations, said electrically operable system being constructed and arranged with respect to said inner and outer door locking mechanisms to selectively move (1) said inner door locking mechanism between the inoperative and inner door locking position thereof in response to inner manual electrical energizing actuations and (2) said outer door locking mechanism between the inoperative and outer door locking positions thereof in response to outer manual electrical energizing actuations, the arrangement being such that an outer manual electrical energizing actuation without a corresponding inner manual electrical energizing actuation causes said door latching assembly when in the door latching position thereof to be incapable of being moved into the door unlatching position thereof by said outer door latch releasing mechanism while at the same time said door latching assembly is capable of being moved into the door unlatching position thereof by said inner door latch releasing mechanism, each one of said power-operated vehicle door locking assemblies further including a key actuated door locking and unlocking assembly constructed and arranged with respect to said housing assembly to be moved between a locked mode and an unlocked mode in response to the manual movement of a key therein, said key actuated door locking and unlocking assembly being constructed and arranged with respect to said electrically operable system to provide outer electrical energizing actuations for said electrically operable system when moved away from the locked and unlocked modes thereof by manual movements of a key therein, wherein said key actuated door locking and unlocking assembly is constructed and arranged to be manually moved when in said locked mode from a key entering and exiting position in one turning direction into an unlocked position in said unlocked mode and when in said unlocked mode from the key entering and exiting position in an opposite turning direction into a locked position in said locked mode, said outer and inner manual electrical energizing actuations including electric signals generated in response to the manual movement of said key actuated door locking and unlocking assembly out of the key entering and exiting position in either of said turning directions, wherein said key actuated door locking and unlocking assembly is constructed and arranged with respect to said outer and inner door locking mechanisms to effect a mechanical movement thereof in the event of a failure of the electricity source from the locked position thereof to the unlocked position thereof in response to the turning movement of said key actuated door locking and unlocking assembly when in said locked mode in said one direction from the key entering and exiting position thereof into the unlocked position thereof, and wherein said door latching assembly includes a holding and releasing lever movable between holding and releasing positions, said outer door latch releasing mechanism including an outer releasing arm movable from an inoperative position into a releasing position to move said holding and releasing lever from the holding position thereof into the releasing position thereof, said inner door latch releasing mechanism including an inner releasing arm movable from an inoperative position into a releasing position to move said holding and releasing lever from the holding position thereof into the releasing position thereof.

11. A power-operated vehicle door locking system as defined in claim 10, wherein said electrically operable system includes a crash sensor and wherein each outer door locking mechanism is moved to the inoperative position by the electrically operable system whenever a signal from said crash sensor indicates that a crash has occurred.

12. A power-operated vehicle door locking system as defined in claim 11, wherein said electrically operable system further includes a charge storage device which provides sufficient power to said electrically operable system to effect movement of each outer door locking mechanism to the inoperative position even if a power supply to the power-operated vehicle door locking system is interrupted.

13. A power-operated vehicle door locking system as defined in claim 10, further comprising a manually actuatable child lock switch electrically connected to said electrically operable system, said electrically operable system being responsive to actuation of said child lock switch by moving at least one of the inner door locking mechanisms to the inner door locking position thereof whenever the child lock switch is actuated.

14. A power-operated vehicle door locking system as defined in claim 13, wherein said electrically operable system is further responsive to actuation of the child lock switch by moving at least one of the outer door locking mechanisms to the inoperative position whenever the child lock switch is actuated.

15. A power-operated vehicle door locking system as defined in claim 10, wherein said electrically operable system is adapted to receive a status signal indicative of whether a transmission is in a PARK status, said electrically operable system being responsive to said status signal by moving at least one of said outer door locking mechanisms into the door locking position thereof whenever said status signal indicates that said transmission is not in PARK.

16. A power-operated vehicle door locking system as defined in claim 10, wherein said electrically operable system is adapted to receive a status signal indicative of whether a transmission is in a drive status, said electrically operable system being responsive to said status signal by moving at least one of said outer door locking mechanisms into the door locking position thereof whenever said status signal indicates that said transmission is in a drive status.

17. A power-operated vehicle door locking system as defined in claim 10, further comprising a manually actuatable lock switch electrically connected to said electrically operable system, said electrically operable system being responsive to said manually actuatable lock switch such that a first kind of actuation of said manually actuatable lock switch causes said electrically operable system to move at least one of said outer door locking mechanism and said inner door locking mechanism in at least one of said assemblies into one of four position combinations, said four position combinations including:

- a first position combination wherein said inner and outer door locking mechanisms are in said inoperative position;
- a second position combination wherein said inner door locking mechanism is in the door locking position and said outer door locking mechanism is in the inoperative position;
- a third position combination wherein said outer door locking mechanism is in the door locking position and said inner door locking mechanism is in the inoperative position; and
- a fourth position combination wherein said inner and outer door locking mechanisms are both in said door locking position.

18. A power-operated vehicle door locking system as defined in claim 17, wherein said electrically operable system is further responsive to said manually actuatable lock switch such that a second kind of actuation of said manually actuatable lock switch causes said electrically operable system to move at least one of said outer door locking mechanism and said inner door locking mechanism of said at least one assembly into another one of said four position combinations which is different from that which is achieved by said first kind of actuation.

19. A power-operated vehicle door locking system as defined in claim 18, wherein said electrically operable system is further responsive to said manually actuatable lock switch such that a third kind of actuation of said manually actuatable lock switch causes said electrically operable system to move at least one of said outer door locking mechanism and said inner door locking mechanism of said at least one of said assemblies into yet another one of said four position combinations which is different from that which is achieved by said first and second kinds of actuation.

20. A power-operated vehicle door locking system as defined in claim 19, wherein said electrically operable system is further responsive to said manually actuatable lock switch such that a fourth kind of actuation of said manually actuatable lock switch causes said electrically operable system to move at least one of said outer door locking mechanism and said inner door locking mechanism of said at least one of said assemblies into a last one of said four position combinations which is different from that which is achieved by said first, second and third kinds of actuation.

21. A power-operated vehicle locking system as defined in claim 20, wherein said manually actuatable switch is a single switch, wherein said first kind of actuation involves pressing said single switch in a first direction, said second kind of actuation involves successively pressing said single switch twice in said first direction, said third kind of actuation involves pressing said single switch in a second direction, and said fourth kind of actuation involves successively pressing said single switch twice in said second direction.

22. A power-operated vehicle locking system as defined in claim 10, wherein said power-operated vehicle locking system is adapted for a vehicle having two front doors and two rear doors, and wherein said plurality of power-operated vehicle door locking assemblies includes two front door power-operated vehicle door locking assemblies and two rear door power-operated vehicle door locking assemblies.

23. A power-operated vehicle door locking system as defined in claim 22, wherein said electrically operable system includes a crash sensor and wherein each outer door locking mechanism is moved to the inoperative position by the electrically operable system whenever a signal from said crash sensor indicates that a crash has occurred.

24. A power-operated vehicle door locking system as defined in claim 23, wherein said electrically operable system further includes a charge storage device which provides sufficient power to said electrically operable system to effect movement of each outer door locking mechanism to the inoperative position even if a power supply to the power-operated vehicle door locking system is interrupted.

25. A power-operated vehicle door locking system as defined in claim 22, further comprising a manually actuatable child lock switch electrically connected to said electrically operable system, said electrically operable system being responsive to actuation of said child lock switch by moving the inner door locking mechanisms of said two rear door power-operated vehicle door locking assemblies to the inner door locking position thereof whenever the child lock switch is actuated.

26. A power-operated vehicle door locking system as defined in claim 25, wherein said electrically operable system is further responsive to actuation of the child lock switch by moving the outer door locking mechanisms of said two rear door power-operated vehicle door locking assemblies to the inoperative position whenever the child lock switch is actuated.

27. A power-operated vehicle door locking system as defined in claim 22, wherein said electrically operable system is adapted to receive a status signal indicative of whether a transmission is in a PARK status, said electrically operable system being responsive to said status signal by moving at least one of said outer door locking mechanisms into the door locking position thereof whenever said status signal indicates that said transmission is not in PARK.

28. A power-operated vehicle door locking system as defined in claim 22, wherein said electrically operable system is adapted to receive a status signal indicative of whether a transmission is in a drive status, said electrically operable system being responsive to said status signal by moving at least one of said outer door locking mechanisms into the door locking position thereof whenever said status signal indicates that said transmission is in a drive status.

29. A power-operated vehicle door locking system as defined in claim 22, further comprising a manually actuatable lock switch electrically connected to said electrically operable system, said electrically operable system being responsive to said manually actuatable lock switch such that a first kind of actuation of said manually actuatable lock switch causes said electrically operable system to move at least one of said outer door locking mechanism and said inner door locking mechanism in at least one of said assemblies into one of four position combinations, said four position combinations including:

a first position combination wherein said inner and outer door locking mechanisms are in said inoperative position;

a second position combination wherein said inner door locking mechanism is in the door locking position and said outer door locking mechanism is in the inoperative position;

a third position combination wherein said outer door locking mechanism is in the door locking position and said inner door locking mechanism is in the inoperative position; and a fourth position combination wherein said inner and outer door locking mechanisms are both in said door locking position.

30. A power-operated vehicle door locking system as defined in claim 29, wherein said electrically operable system is further responsive to said manually actuatable lock switch such that a second kind of actuation of said manually actuatable lock switch causes said electrically operable system to move at least one of said outer door locking mechanism and said inner door locking mechanism of said at least one assembly into another one of said four position combinations which is different from that which is achieved by said first kind of actuation.

31. A power-operated vehicle door locking system as defined in claim 30, wherein said electrically operable system is further responsive to said manually actuatable lock switch such that a third kind of actuation of said manually actuatable lock switch causes said electrically operable system to move at least one of said outer door locking mechanism and said inner door locking mechanism of said at least one of said assemblies into yet another one of said four position combinations which is different from that which is achieved by said first and second kinds of actuation.

32. A power-operated vehicle door locking system as defined in claim 31, wherein said electrically operable system is further responsive to said manually actuatable lock switch such that a fourth kind of actuation of said manually actuatable lock switch causes said electrically operable system to move at least one of said outer door locking mechanism and said inner door locking mechanism of said at least one of said assemblies into a last one of said four position combinations which is different from that which is achieved by said first, second and third kinds of actuation.

33. A power-operated vehicle locking system as defined in claim 32, wherein said manually actuatable switch is a single switch, wherein said first kind of actuation involves pressing said single switch in a first direction, said second kind of actuation involves successively pressing said single switch twice in said first direction, said third kind of actuation involves pressing said single switch in a second direction, and said fourth kind of actuation involves successively pressing said single switch twice in said second direction.

34. A power-operated vehicle locking system as defined in claim 29, wherein said electrically operable system includes:

a motor at each of said assemblies for moving outer and inner door locking mechanisms at respective ones of said assemblies into a selectively chosen one of said four position combinations;

a processor capable of selectively activating, based on a programmed operation scheme, each motor to achieve any one of said four position combinations at each vehicle door locking assembly in a manner dependent upon input signals.

35. A power-operated vehicle locking system as defined in claim 34, wherein each vehicle door locking assembly includes a position sensor, said input signals including at least one position indicative signal from each position sensor.

36. A power-operated vehicle locking system as defined in claim 29, wherein said electrically operable system includes:

a first motor at each of said assemblies for individually moving each outer door locking mechanism between said inoperative and said door locking positions;

a second motor at each of said assemblies for individually moving each inner door locking mechanism between said inoperative and said door locking positions;

a processor capable of selectively activating, based on a programmed operation scheme, each motor to achieve any one of said four position combinations at each vehicle door locking assembly in a manner dependent upon input signals.

37. A power-operated vehicle locking system as defined in claim 22, wherein said electrically operable system includes:

a motor at each of said assemblies for moving outer and inner door locking mechanisms at respective ones of said assemblies to achieve any combination of said inoperable position, said inner door locking position, and said outer door locking position;

a processor capable of selectively activating, based on a programmed operation scheme, each motor to achieve any combination of said inoperable position, said inner door locking position, and said outer door locking position at each vehicle door locking assembly in a manner dependent upon input signals.

38. A power-operated vehicle locking system as defined in claim 37, wherein each vehicle door locking assembly includes a position sensor, said input signals including at least one position indicative signal from each position sensor.

39. A power-operated vehicle locking system as defined in claim 22, wherein said electrically operable system includes:

a first motor at each of said assemblies for individually moving each outer door locking mechanism between said inoperative and said door locking positions;

a second motor at each of said assemblies for individually moving each inner door locking mechanism between said inoperative and said door locking positions;

a processor capable of selectively activating, based on a programmed operation scheme, each motor to achieve any one of said four position combinations at each vehicle door locking assembly in a manner dependent upon input signals.

* * * * *